US008801521B2

(12) United States Patent
Haga et al.

(10) Patent No.: US 8,801,521 B2
(45) Date of Patent: Aug. 12, 2014

(54) STORAGE MEDIUM STORING SOUND OUTPUT PROGRAM, SOUND OUTPUT APPARATUS AND SOUND OUTPUT CONTROL METHOD

(75) Inventors: Takayuki Haga, Kyoto (JP); Shinji Okane, Kyoto (JP)

(73) Assignee: Nintendo Co., Ltd., Kyoto (JP)

( * ) Notice: Subject to any disclaimer, the term of this patent is extended or adjusted under 35 U.S.C. 154(b) by 1171 days.

(21) Appl. No.: 11/542,237

(22) Filed: Oct. 4, 2006

(65) Prior Publication Data

US 2007/0265104 A1 Nov. 15, 2007

(30) Foreign Application Priority Data

Apr. 27, 2006 (JP) ..... 2006-123426

(51) Int. Cl.
*A63F 9/00* (2006.01)
*G10H 1/34* (2006.01)

(52) U.S. Cl.
CPC ..... *G10H 1/348* (2013.01); *G10H 2220/401* (2013.01); *G10H 2220/395* (2013.01); *G10H 2250/435* (2013.01); *G10H 2220/206* (2013.01); *A63F 2300/1006* (2013.01); *A63F 2300/8047* (2013.01)
USPC ..... 463/37

(58) Field of Classification Search
USPC ..... 463/36, 37
See application file for complete search history.

(56) References Cited

U.S. PATENT DOCUMENTS 4,980,519 A 12/1990 Mathews
5,058,480 A * 10/1991 Suzuki et al. ..... 84/600
5,290,964 A * 3/1994 Hiyoshi et al. ..... 84/600
5,585,584 A 12/1996 Usa
5,920,024 A 7/1999 Moore
6,375,572 B1 * 4/2002 Masuyama et al. ..... 463/43
6,641,482 B2 * 11/2003 Masuyama et al. ..... 463/44
6,669,563 B1 * 12/2003 Kitami et al. ..... 463/36
6,759,583 B2 * 7/2004 Mizuno et al. ..... 84/422.4
6,867,361 B2 * 3/2005 Nishitani et al. ..... 84/658
6,908,386 B2 * 6/2005 Suzuki et al. ..... 463/30

(Continued)

FOREIGN PATENT DOCUMENTS

EP 1 631 049 3/2006
JP 63-132295 6/1988

(Continued)

OTHER PUBLICATIONS

Office Action dated Jul. 13, 2010 in parent Japanese Patent Application No. 2006-123426.

*Primary Examiner* — Seng H Lim
(74) *Attorney, Agent, or Firm* — Nixon & Vanderhye, P.C.

(57) ABSTRACT

A video game apparatus as a sound output apparatus includes a CPU, and the CPU detects acceleration data included in input information data transmitted from a controller. The acceleration data is numerical value data for accelerations in three axial directions set to the controller. For example, a swinging motion of the controller in a right direction or a left direction is determined based on the acceleration in a direction of one axis (x-axis) out of three axes. In addition, a downward swinging motion of the controller and a posture of the controller at the time of end of swing are determined based on the acceleration in directions of two axes (y-axis and z-axis) other than the one axis. Accordingly, for example, a performance of a musical instrument displayed on a game screen is individually instructed.

8 Claims, 20 Drawing Sheets

(56) References Cited

U.S. PATENT DOCUMENTS

| | | | | |
|---|---|---|---|---|
| 6,908,388 | B2 * | 6/2005 | Shimizu et al. | 463/31 |
| 6,919,503 | B2 * | 7/2005 | Nishitani et al. | 84/633 |
| 6,933,434 | B2 * | 8/2005 | Nishitani et al. | 84/615 |
| 7,060,885 | B2 * | 6/2006 | Ishida et al. | 84/626 |
| 7,094,147 | B2 * | 8/2006 | Nakata et al. | 463/9 |
| 7,169,998 | B2 * | 1/2007 | Kondo et al. | 84/615 |
| 7,474,197 | B2 * | 1/2009 | Choi et al. | 340/384.7 |
| 7,491,879 | B2 * | 2/2009 | Hikino et al. | 84/615 |
| 7,890,199 | B2 * | 2/2011 | Inagaki | 700/94 |
| 2001/0014616 | A1 * | 8/2001 | Matsuda et al. | 455/567 |
| 2002/0126014 | A1 | 9/2002 | Nishitani et al. | |
| 2003/0066413 | A1 | 4/2003 | Nishitani et al. | |
| 2003/0216179 | A1 * | 11/2003 | Suzuki et al. | 463/35 |
| 2004/0011189 | A1 | 1/2004 | Ishida et al. | |
| 2004/0040434 | A1 | 3/2004 | Kondo et al. | |
| 2004/0176025 | A1 * | 9/2004 | Holm et al. | 455/3.06 |
| 2006/0060068 | A1 * | 3/2006 | Hwang et al. | 84/615 |
| 2006/0283233 | A1 * | 12/2006 | Cordani | 73/12.01 |
| 2007/0137462 | A1 * | 6/2007 | Barros et al. | 84/453 |
| 2007/0255434 | A1 * | 11/2007 | Inagaki | 700/94 |
| 2007/0256546 | A1 * | 11/2007 | Hikino et al. | 84/615 |
| 2007/0265104 | A1 * | 11/2007 | Haga et al. | 473/37 |
| 2009/0318227 | A1 * | 12/2009 | Nakajima | 463/35 |
| 2012/0120000 | A1 * | 5/2012 | Lucic et al. | 345/173 |

FOREIGN PATENT DOCUMENTS

| | | |
|---|---|---|
| JP | 63-192096 | 8/1988 |
| JP | 05-341786 | 12/1993 |
| JP | 06-208374 | 7/1994 |
| JP | 10-214155 | 8/1998 |
| JP | 2000-317134 | 11/2000 |
| JP | 2002-023743 | 1/2002 |
| JP | 2004-252149 | 9/2004 |

* cited by examiner

FIG. 8

(A1) CHANGE OF CONTROLLER IN AXIAL DIRECTION WHEN CONTROLLER SWINGS IN RIGHT DIRECTION

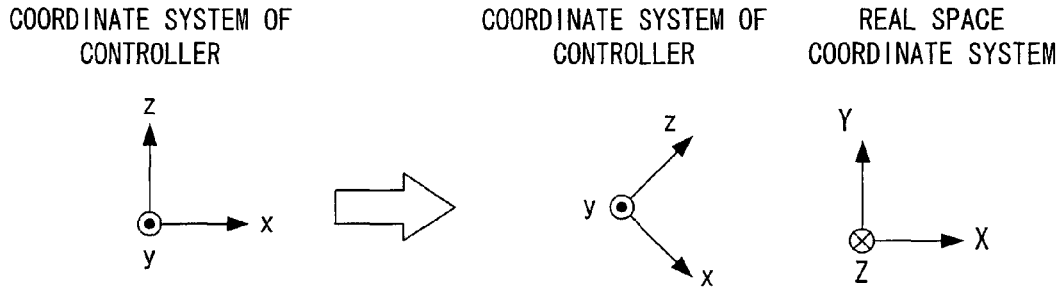

(A2) CHANGE OF ACCELERATION ACCORDING TO x-AXIS AND z-AXIS WHEN THE CONTROLLER SWINGS IN THE RIGHT DIRECTION

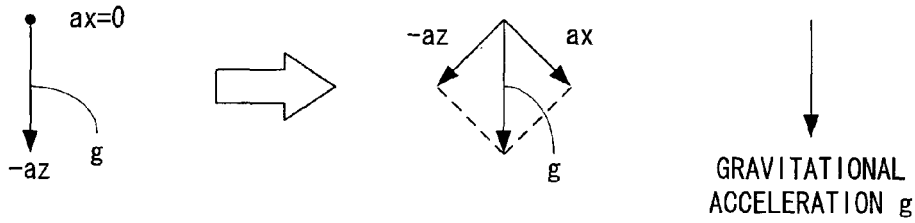

(B1) CHANGE OF CONTROLLER IN AXIAL DIRECTION WHEN THE CONTROLLER SWINGS IN THE LEFT DIRECTION

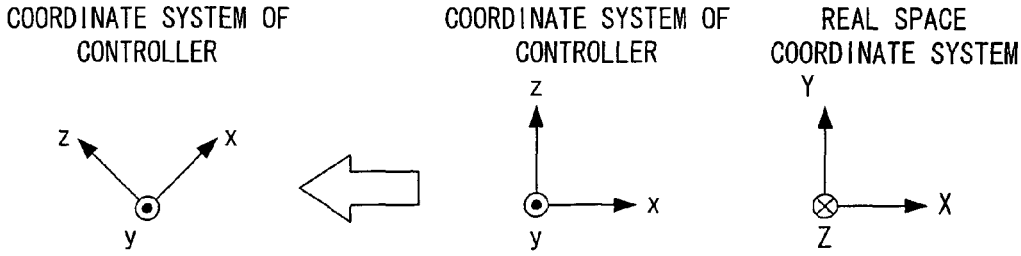

(B2) CHANGE OF ACCELERATION ACCORDING TO x-AXIS AND z-AXIS WHEN THE CONTROLLER SWINGS IN THE LEFT DIRECTION

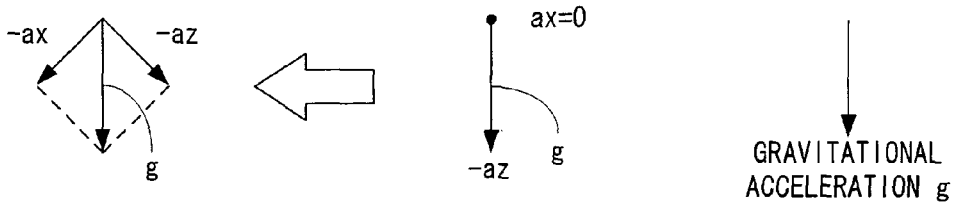

FIG. 9

(A1) CHANGE OF CONTROLLER IN AXIAL DIRECTION WHEN THE CONTROLLER SWINGS DOWNWARD AND STOPPED AT UPPER PART

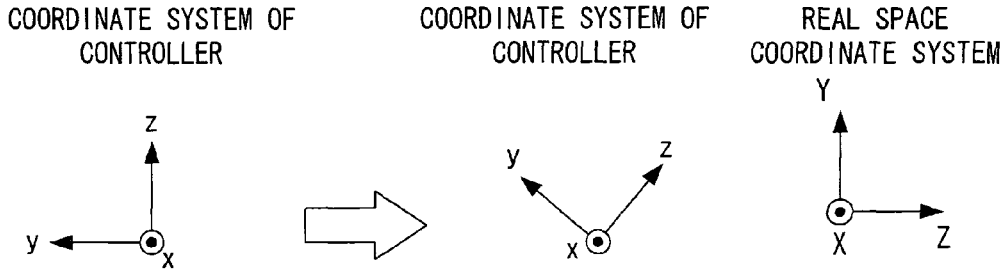

(A2) CHANGE OF ACCELERATION ACCORDING TO y-AXIS AND z-AXIS WHEN THE CONTROLLER SWINGS DOWNWARD

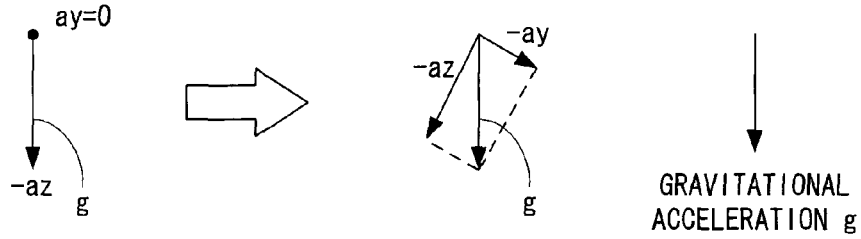

(B1) CHANGE OF CONTROLLER IN AXIAL DIRECTION WHEN THE CONTROLLER SWINGS DOWNWARD AND STOPPED AT HORIZONTAL POSITION

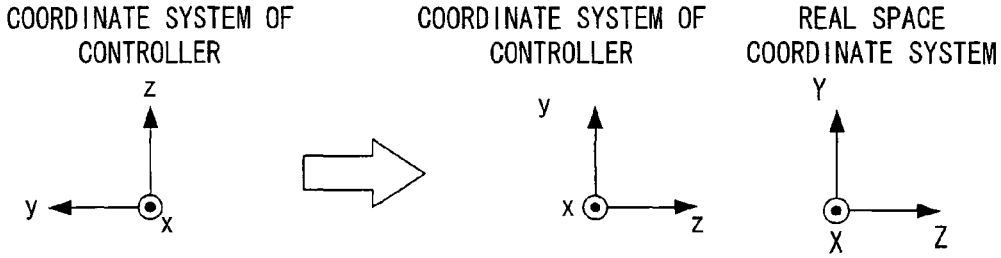

(B2) CHANGE OF ACCELERATION ACCORDING TO y-AXIS AND z-AXIS WHEN THE CONTROLLER SWINGS DOWNWARD

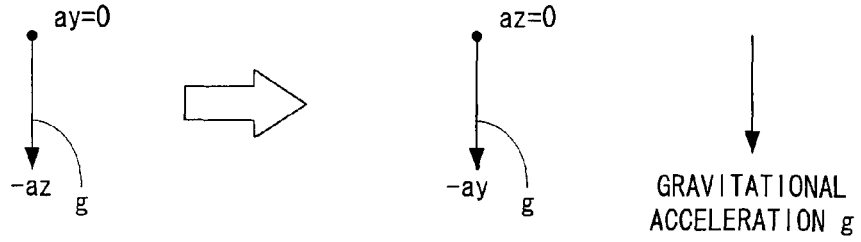

FIG. 17
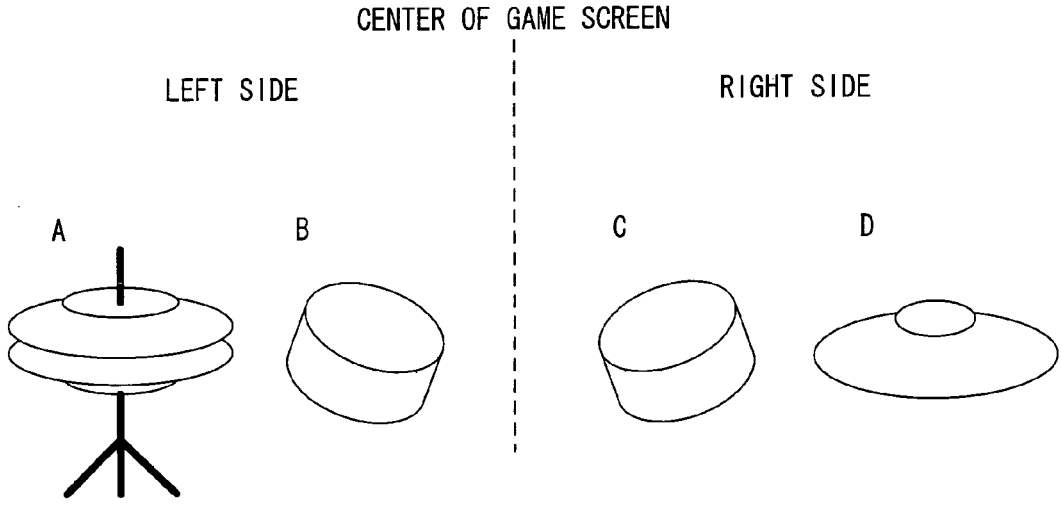
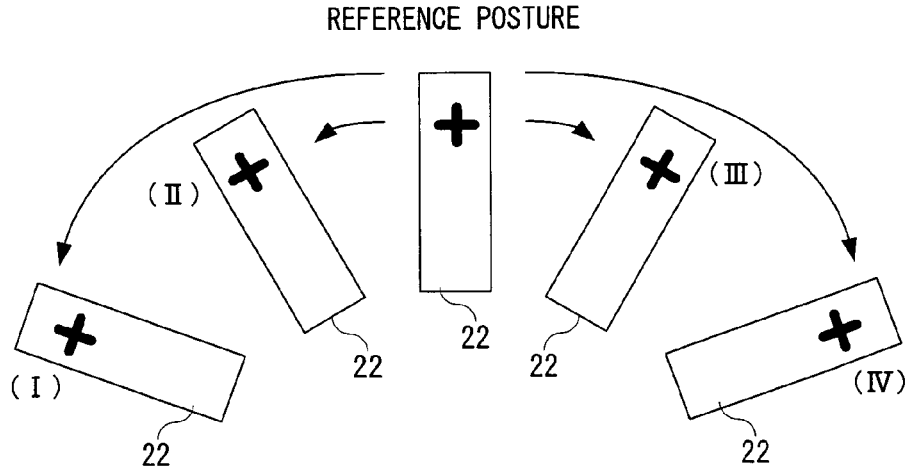

STORAGE MEDIUM STORING SOUND OUTPUT PROGRAM, SOUND OUTPUT APPARATUS AND SOUND OUTPUT CONTROL METHOD

CROSS REFERENCE TO RELATED APPLICATION

The disclosure of Japanese Patent Application No. 2006-123426 is incorporated herein by reference.

TECHNICAL FIELD

The exemplary embodiments disclosed herein relate to a storage medium storing sound output program, a sound output apparatus and a sound output control method. More specifically, exemplary embodiments disclosed herein relate to a storage medium storing sound output program, a sound output apparatus and a sound output method, which output a sound of a musical instrument in accordance with a swinging motion of an operating means including an acceleration sensor.

BACKGROUND AND SUMMARY

One of the examples of this kind of related arts is disclosed in Japanese Patent Laying-open No. 63-132295 [G10H1/00, 1/053] (document 1) laid-open on Jun. 4, 1988. According to this document 1, three acceleration sensors are attached to one end part of a drumstick, and acceleration in three directions of X, Y, Z is detected. In addition, sounds of different musical instruments are assigned corresponding to each direction. Accordingly, by detecting a swinging motion from an output of the acceleration sensor, the sound of the corresponding instrument can be outputted.

Also, another example of the related art is disclosed in Japanese Patent Laying-open No. 63-192096 [G10H1/00, 1/053] (document 2) laid-open on Aug. 9, 1988. According to this document 2, an angle detection means is incorporated into a grip part of a stick. Based on an on/off state of a plurality of mercury switches constituting the angle detection means, an angle formed by the angle detection means with respect to the ground, specifically, a swing-up angle of the stick is detected, and pitch data corresponding to a detection result thus obtained is outputted to a musical sound signal generating circuit.

However, a technique recited in the document 1 involves a problem that only one tone can be outputted in one swing direction and therefore a swinging attitude of a swinging instrument such as a stick is not associated with the output of the tone. This unfavorably invites a monotonous swing.

Further, the technique recited in the document 2 involves a problem that the swing-up angle of the stick (tilt of the stick) is detected by the mercury switches. This can not be a practical technique, when a danger caused by using mercury and a cost incurred therein are taken into consideration.

Therefore, it is a feature of certain exemplary embodiments to provide a novel storage medium storing sound output program, sound output apparatus and sound output control method.

Another feature of certain exemplary embodiments is to provide a storage medium storing sound output program, a sound output apparatus and a sound output control method capable of enjoying a sound outputted in accordance with a swinging motion by a user.

For resolution of the above mentioned problems, certain exemplary embodiments employ such a structure described below. The reference numerals and supplementary explanations, etc. in parentheses here indicate merely one example of correspondence with the exemplary embodiments described later for aid of understanding, and imposes no limitations on the certain exemplary embodiments described herein.

A storage medium storing sound output program according to certain exemplary embodiments stores the sound output program of a sound output apparatus comprising an operating means including an acceleration sensor. The sound output program causes a processor of a sound output apparatus to function as a swinging motion detection means, a swinging motion end determination means, a posture detection means, and a sound output means. The swinging motion detection means detects a swinging motion of the operating means based on an output of the acceleration sensor. The motion end determination means determines whether or not the swinging motion is ended based on the output of the acceleration sensor after the swinging motion is detected by the swinging motion detection means. The posture detection means detects a posture of the operating means based on the output of the acceleration sensor when the swinging motion end determination means determines that the swinging motion is ended. The sound output means outputs a sound based on tone data stored in storage means in accordance with a detection result of the posture detection means.

Specifically, the sound output program is incorporated into a sound output apparatus (12) comprising an operating means (22) including an acceleration sensor (74). The sound output program causes a processor (36) of a sound output apparatus to function as a swinging motion detection means (36, S23, S43, S61, S63, S65, S67, S69, S95, S99), a swinging motion end determination means (36, S27, S47, S69, S105), and a posture detection means (36, S71), and a sound output means (36, S29, S49, S73, S75, S109, S111). The swinging motion detection means detects the swinging motion of the operating means based on the output of the acceleration sensor. For example, the swinging motion in a lateral direction (right and left) or the swinging motion in a vertical direction (upper and lower) is detected. The motion end determination means determines whether or not the swinging motion is ended based on the output of the acceleration sensor, after the swinging motion is detected by the swinging motion detection means. For example, variation of the output from the acceleration sensor is detected, and when the direction of the variation is not changed, the motion end determination means determines that the swinging motion is not ended. Meanwhile, when there is no variation of the output of the acceleration sensor, namely, when the output of the acceleration sensor shows a fixed value or almost the fixed value, the motion end determination means determines that the swinging motion is ended. The posture detection means detects the posture of the operating means based on the output of the acceleration sensor when the swinging motion end determination means determines that the swinging motion is ended. For example, a position (height) of the operating means during swinging motion is detected. The sound output means outputs the sound based on tone data stored in the storage means in accordance with a detection result of the posture detection means. For example, the sound in accordance with the position of the operating means is outputted.

According to certain exemplary embodiments, since the sound is outputted in accordance with a swinging motion of the operating means, a user can enjoy the sound outputted in accordance with the swinging motion by the user. In addition, since the sound is outputted in accordance with a swinging attitude of the operating means, a user can experience a sense as if he/she plays an actual musical instrument.

According to an exemplary embodiment, the acceleration sensor serves as a multiaxial acceleration sensor, and the processor further causes the sound output program to function as a direction determination means for determining a direction of the swinging motion based on the acceleration in directions of two axes of the multiaxial acceleration sensor. Moreover, the posture detection means includes a vertical directional inclination detection means for detecting an inclination formed by the operating means and a horizontal surface in a vertical direction based on the acceleration in a direction of the axis perpendicularly crossing the two axes, when the determination result of the direction determination means shows the vertical direction, and the sound output means reads from the storage means the tone data corresponding to the position in the vertical direction, in accordance with the inclination thus detected by the vertical directional inclination detection means, the acceleration sensor specifically serves as the multiaxial acceleration sensor. The sound output program causes the processor of the sound output apparatus to further function as a direction determination means (36, S21, S23, S25, S41, S43, S45, S61, S63, S65, S67, S69). The direction determination means determines the direction of the swinging motion based on the acceleration in directions of the two axes (x-axis and y-axis of 22) of the multiaxial acceleration sensor. The vertical directional inclination detection means (36, S71) detects the inclination in the vertical direction formed by the operating means and the horizontal surface based on the acceleration in the direction of the axis (z-axis) perpendicularly crossing the two axes (x-axis and y-axis), when the determination result of the direction determination means shows a vertical direction ("YES" in S69). The sound output means reads from the storage means the tone data corresponding to the position in the vertical direction in accordance with the inclination detected by the vertical directional inclination detection means. For example, when the operating means swings in the vertical direction, the position of the operating means in the vertical direction (height) is determined in accordance with the inclination of the operating means in a state of end of swinging, and the sound of the tone in accordance with the height is outputted. Namely, when the operating means swings in the vertical direction, it is possible to output the sound in accordance with the position of its end of swinging.

According to another exemplary embodiment, when the determination result of the direction determination means shows a right direction, the sound output means reads from the storage means the tone data in accordance with the right direction. Meanwhile, when the determination result of the direction determination means shows a left direction, the sound output means reads from the storage means the tone data in accordance with the left direction. Specifically, when the determination result of the direction determination means shows the right direction, the sound output means reads from the storage means the tone data in accordance with the right direction. Meanwhile, when the determination result of the direction determination means shows the left direction, the sound output means reads from the storage means the tone data in accordance with the left direction. Namely, by the sound output means, the sound in accordance with the swinging motion in the right direction or the swinging motion in the left direction is outputted. In this case, the posture of the end of swinging is of no relevance. Therefore, the processing by the posture detection means is not executed. Thus, it is possible to output the sound in accordance with the swinging attitude of the operating means which is divided into right and left.

According to one aspect of certain exemplary embodiments, the sound output apparatus further comprises a display means, and the sound output program causes the processor to function as a guidance screen display means for displaying a guidance screen to guide the swinging motion on a display means, and the direction shown by the determination result of the direction determination means corresponds to the direction in the guidance screen. Specifically, the sound output program causes the processor of the sound output apparatus to further function as a guidance screen display means (36, S3). The guidance screen display means displays on the display means a guidance screen (100) for guiding the swinging motion. The direction (vertical, right or left direction) shown by the determination result of the direction determination means corresponds to the direction in the guidance screen. For example, the upper, lower, left and right swinging motions correspond to the upper, lower, left and right sides on the guidance screen. Accordingly, for example, when an image of the musical instrument is displayed in the upper, lower, left and right sides on the guidance screen, a player can play a desired musical instrument by the swinging motion of the operating means by viewing the image of the musical instrument. Namely, the player can enjoy the sound in accordance with its swinging motion.

The sound output apparatus according to certain exemplary embodiments comprises the operating means including the acceleration sensor. Also, the sound output apparatus comprises the swinging motion detection means, the swinging motion end determination means, the posture detection means, and the sound output means. The swinging motion detection means detects the swinging motion of the operating means based on the output of the acceleration sensor. The swinging motion end determination means determines whether or not the swinging motion is ended based on the output of the acceleration sensor, after the swinging motion is detected by the swinging motion detection means. When the swinging motion end determination means determines that the swinging motion is ended, the posture detection means detects the posture of the operating means based on the output of the acceleration sensor. The sound output means outputs the sound based on the tone data stored in the storage means, in accordance with the detection result of the posture detection means.

According to the sound output apparatus of certain exemplary embodiments, in the same way as the storage medium storing sound output program as described above, a user can enjoy the sound outputted in accordance with the swinging motion by the user.

A sound output control method according to certain exemplary embodiments, which is the sound output control method of the sound output apparatus having the operating means including the acceleration sensor, comprises the steps of (a) detecting the swinging motion of the operating means based on the output of the acceleration sensor; (b) determining whether or not the swinging motion is ended based on the output of the acceleration sensor after the swinging motion is detected by step (a); (c) detecting the posture of the operating means based on the output of the acceleration sensor when determination in step (b) shows that the swinging motion is ended; and (d) outputting the sound based on the tone data stored in the storage means in accordance with the detection result of step (c).

According to the sound output control method of certain exemplary embodiments, in the same way as the storage medium storing sound output program as described above, a user can enjoy the sound outputted in accordance with the swinging motion by the user.

The above described features, aspects and advantages of the certain exemplary embodiments described herein will become more apparent from the following detailed description when taken in conjunction with the accompanying drawings.

BRIEF DESCRIPTION OF THE DRAWINGS

FIG. 8 is an illustrative view for explaining the swinging motion of the controller in a vertical direction;

FIG. 9 is an illustrative view for explaining the determination method of a swinging direction when the controller swings in the vertical direction;

FIG. 17 is an illustrative view for explaining an example of an arrangement of musical instruments displayed on other game screen of certain exemplary embodiments and its operating method;

DETAILED DESCRIPTION

Figure 1:
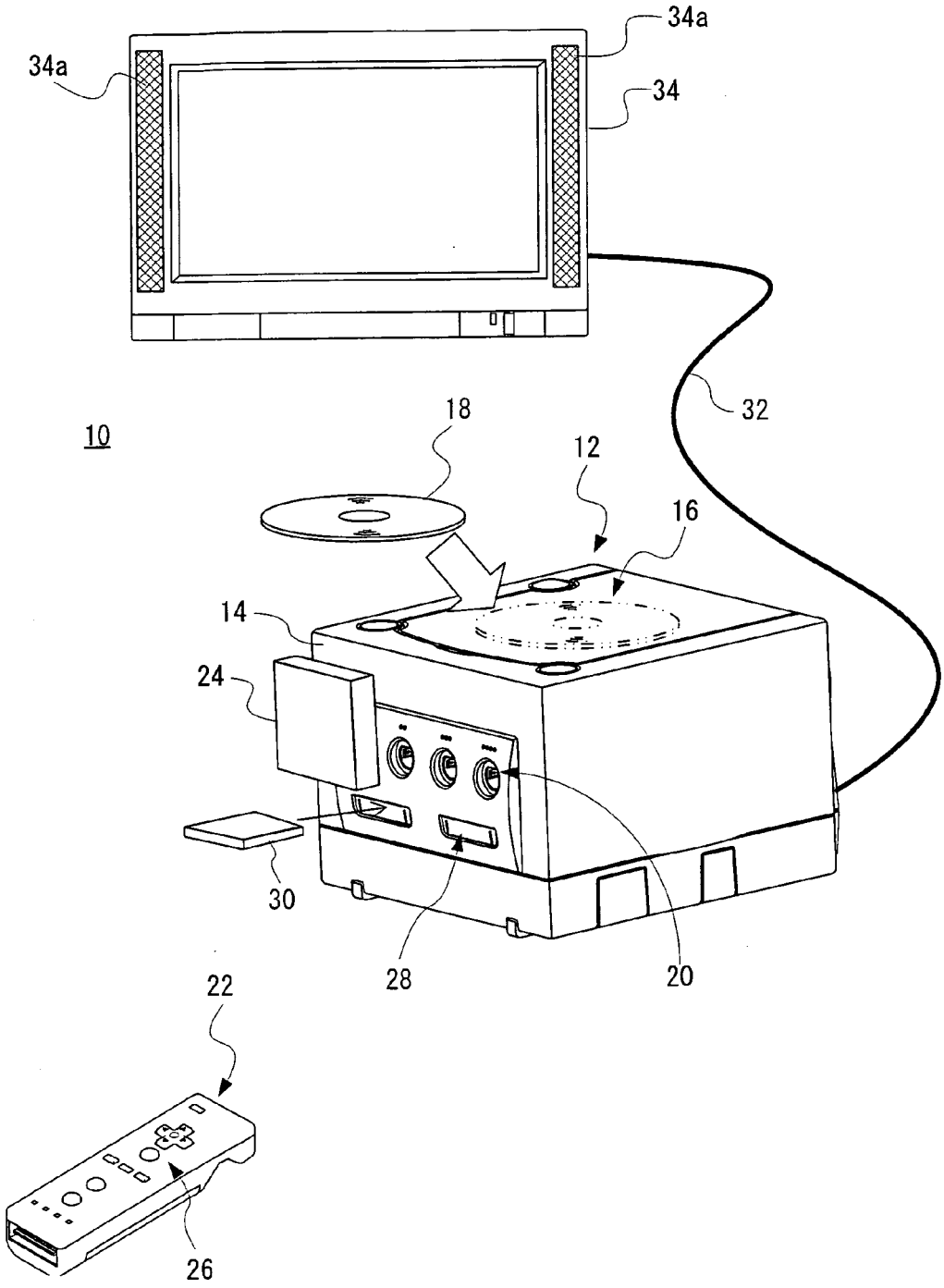
FIG. 1 is an illustrative view showing an exemplary embodiment of a game system.

Referring to FIG. 1, a game system 10, which is an exemplary embodiment, includes a video game apparatus 12. The video game apparatus 12 functions as a music performance apparatus (sound output apparatus) by incorporating a music performance program (game program). The video game apparatus 12 includes an approximately cubic housing 14, and an optical disk drive 16 is provided on an upper end of the housing 14. An optical disk 18, which is an example of an information storage medium storing game program and so forth, is loaded in the optical disk drive 16. A plurality of connectors 20 (four connectors in the exemplary embodiment) are provided on a front face of the housing 14. These connectors 20 function to connect a controller 22 to the video game apparatus 12 through a reception unit 24 by cable or radio. As shown in FIG. 1, in this exemplary embodiment, the reception unit 24 is connected to the connectors 20, and through the reception unit 24, the controller 22 is connected to the video game apparatus 12 by radio. The controller 22 will be described later in detail.

It should be noted that according to this exemplary embodiment, radio communication is performed between the video game apparatus 12 and the controller 22, and therefore it is not originally preferable to use the term, "connection". However, as the term expressing a connected state capable of communicating between the video game apparatus 12 and the controller 22, the term for the cable communication is borrowed and the term "connection" is therefore used for convenience.

Further, one or a plurality of memory slots 28 (two memory slots in this exemplary embodiment) are provided on the front face of the housing 14 and below the connectors 20 of the video game apparatus 12. A memory card 30 is inserted into the memory slot 28. The memory card 30 is used for loading and temporarily storing the game program and so forth read from the optical disk 18, and for saving game data (result data or progress data of a game) of the game played by using the game system 10.

Further, an AV cable connector (not shown) is provided on a back face of the housing 14 of the video game apparatus 12, and a monitor 34 is connected to the video game apparatus 12 through an AV cable 32 by using the connector. The monitor 34 is typically a color television receiver and an image signal from the video game apparatus 12 is inputted to a video input terminal of a color television, and a voice signal is inputted to a voice signal input terminal. Accordingly, a game image of a three dimensional (3D) video game is displayed on a screen of the color television (monitor) 34, and a stereo game voice such as a game music and a sound effect, etc. is outputted from right and left speakers 34*a*.

In the game system 10, when a user or a player plays the game (or other application), first, the user turns on a power supply of the video game apparatus 12, then, the user selects a suitable optical disk 18 storing a video game (or other application that the user wants to play), and loads the optical disk 18 on the disk drive 16 of the video game apparatus 12. In response thereto, the video game apparatus 12 starts to perform the video game or other application based on software stored in the optical disk 18. The user operates the controller 22 for applying input force on the video game apparatus 12. For example, by operating any switch or button of input means 26, the game or other application is started. By moving other one of the input means 26, a moving image object (player object) is moved in a different direction, or a visual point (camera position) of the user in a 3D game world can be changed.

Figure 2:
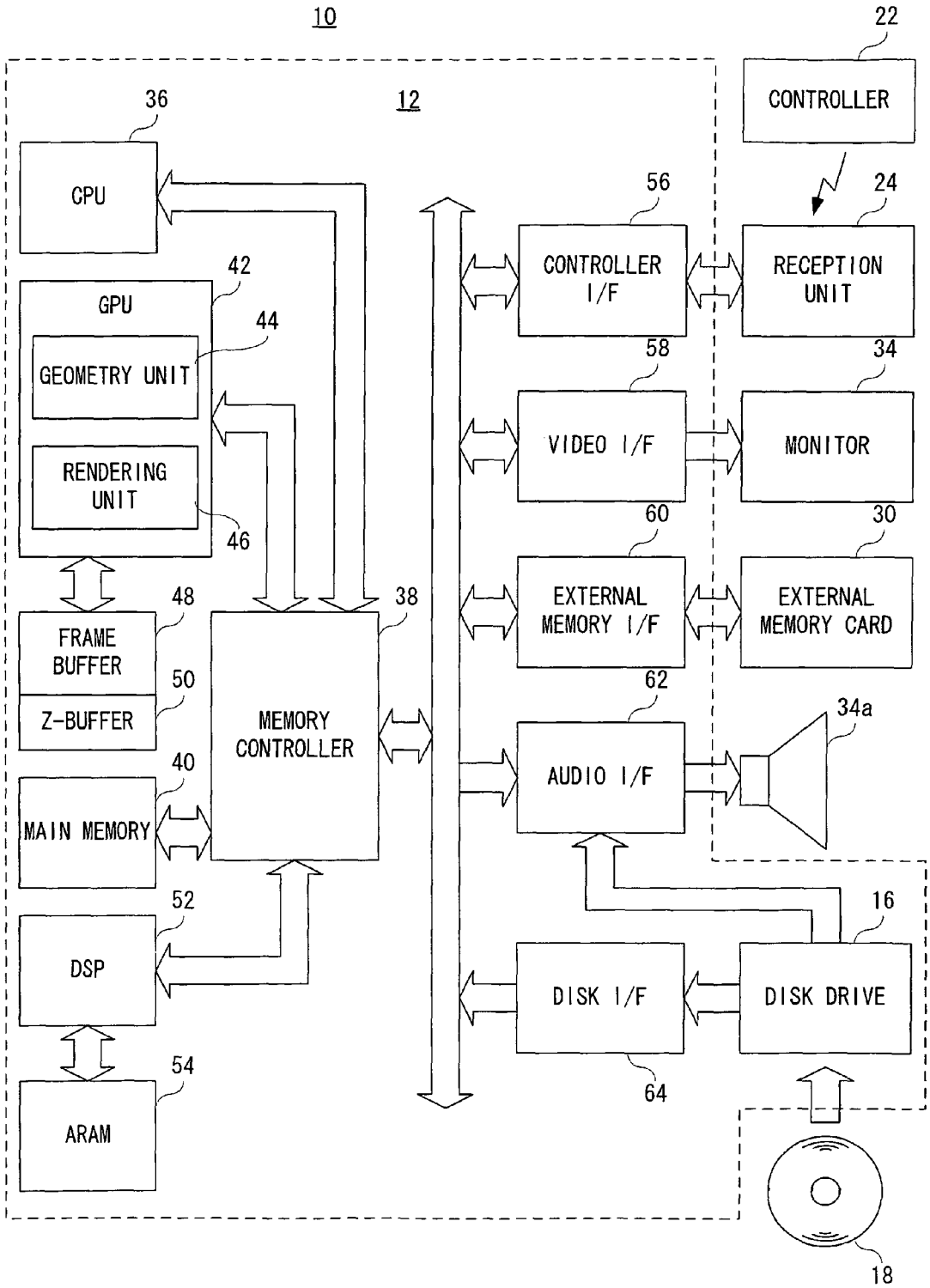
FIG. 2 is a block diagram showing an electric configuration of the game system shown in FIG. 1.

FIG. 2 is a block diagram showing an electric configuration of the video game system 10 according to the exemplary embodiment of FIG. 1. A CPU 36 is provided in the video game apparatus 12. The CPU 36 is in charge of an overall control of the video game apparatus 12. The CPU 36 functions as a game processor, and is connected with a memory controller 38 via a bus. The memory controller 38 mainly controls writing and reading of a main memory 40 connected via the bus under the control of the CPU 36. A GPU (Graphics Processing Unit) 42 is connected to the memory controller 38.

The GPU 42 forms a part of a rendering means, and for example is constituted by a single chip ASIC, receives a graphics command (rendering command) from the CPU 36 via the memory controller 38, and by following the command thus received, generates a 3D game image by a geometry unit 44 and a rendering unit 46. Namely, the geometry unit 44 performs arithmetic processing of rotation, movement, and deformation, etc, of each kind of object of three dimensional coordinate system (formed of a plurality of polygons, and the polygon refers to a polygonal plane defined by at least three vertexes coordinates.) The rendering unit 46 performs image generation processing such as attaching a texture (texture image) to each polygon of each kind of object, and so forth. Accordingly, the 3D image data to be displayed on the game screen is generated by the GPU 42, and the image data thus generated is stored in a frame buffer 48.

Note that necessary data (primitive or polygon and texture, etc) on performing the graphics command by the GPU 42, is obtained from the main memory 40 by the GPU 42 via the memory controller 38.

The frame buffer 48 is a memory for drawing (accumulating) the image data of one frame of a raster scan monitor 34, for example, and is overwritten for every one frame by the GPU 42. Specifically, the frame buffer 48 sequentially stores chromatic information of an image for each one pixel. Here, the chromatic information refers to data on R, G, B, A, and for example, corresponds to R (red) data of 8 bits, G (green) data of 8 bits, B (blue) data of 8 bits, and A (alpha) data of 8 bits. Note that A data is the data on a mask (mat image). The 3D image of the game image is displayed on the screen of the monitor 34 by reading the data of the frame buffer 48 via the memory controller 38 by a video I/F58 as will be described later.

In addition, Z buffer 50 has a storage capacity corresponding to the number of bits of depth data per the number of pixels corresponding to the frame buffer 48 X one pixel, and stores depth information or depth data (Z value) of dots corresponding to each storage location of the frame buffer 48.

Both of the frame buffer 48 and the Z buffer 50 may be constituted by using one portion of the main memory 40, and also these buffers may be provided inside the GPU 42.

In addition, the memory controller 38 is connected to RAM (referred to as "ARAM" hereafter) for audio, via a DSP (Digital Signal Processor) 52. Accordingly, the memory controller 38 controls not only the main memory 40 but also writing and/or reading of the ARAM 54 as a sub-memory.

The DSP 52 works as a sound processor, and generates audio data corresponding to sound, voice or music necessary for the game, by using sound data (not shown) stored in the main memory 40 and by using sound wave (tone) data (see FIG. 11) written in the ARAM 54.

The memory controller 38 is further connected to each interface (I/F) 56, 58, 60, 62, and 64 by the bus. The controller I/F 56 is an interface for the controller 22 connected to the video game apparatus 12 via the reception unit 24. Specifically, the reception unit 24 receives input information data transmitted from the controller 22, and the controller I/F56 gives input information data received by the reception unit 24, to the CPU 36 via the memory controller 38. However, in this exemplary embodiment, the input information data means the data including at least one of operation data and acceleration data as will be described later. The video I/F58 accesses the frame buffer 48, and reads the image data generated by the GPU 42, and applies an image signal or the image data (digital RGBA pixel value) to the monitor 34 via the AV cable 32 (FIG. 1).

An external memory I/F60 connects the memory card 30 (FIG. 1) inserted into the front face of the video game apparatus 12 to the memory controller 38. Whereby, the CPU 36 can write the data into the memory card 30 via the memory controller 38, or can read out the data from the memory card 30. An audio I/F62 receives audio data given from the DSP 52 through the memory controller 38 or audio stream read from the optical disk 18, and gives an audio signal (sound signal) corresponding thereto to a speaker 34*a* of the monitor 34.

Further, a disk I/F64 connects the disk drive 16 to the memory controller 38, and therefore the CPU 36 controls the disk drive 16. By this disk drive 16, program data and texture data, etc, read out from the optical disk 18 are written into the main memory 40 under the control of the CPU 36.

FIG. 3(A) and FIG. 3(B) are perspective views showing an external appearance configuration of the controller 22. Referring to FIG. 3(A) and FIG. 3(B), the controller 22 has a housing 22*a* formed by plastic molding, for example. The housing 22*a* is formed into an approximately rectangular parallelepiped shape, having a size small enough to be held by one hand of a user. As described above, the input means (a plurality of buttons or switches) 26 are provided in the housing 22*a* (controller 22). Specifically, as shown in FIG. 3(A), on an upper face of the housing 22*a* (controller 22), there are provided a cross key 26*a*, X-button 26*b*, Y-button 26*c*, A-button 26*d*, select switch 26*e*, menu (home) switch 26*f*, start switch 26*g*, and power supply switch 26*h*. Moreover, as shown in FIG. 3(B), a concave portion is formed on a lower face of the housing 22*a*, and B-trigger switch 26*i* is formed on a rearward inclined surface of the concave portion.

The cross key 26*a* is a four directional push switch, including four directions of front (or upper), back (or lower), right and left operation parts. By operating any one of the operation parts, it is possible to instruct a moving direction of a character or object (player character or player object) that is be operable by a player or instruct the moving direction of a cursor.

The X-button 26*b* and the Y-button 26*c* are respectively push button switches, and are used for adjusting a viewpoint position and a viewpoint direction on displaying the 3D game image, i.e. a position and an image angle of a virtual camera. Alternatively, the X-button 26*b* and the Y-button 26*c* can be used for the same operation as that of the A-button 26*d* and the B-trigger switch 26*i* or an auxiliary operation.

The A-button switch 26*d* is the push button switch, and is used for causing the player character or the player object to take an action other than that instructed by a directional instruction, specifically arbitrary actions such as punching, throwing, grasping (acquiring), riding, and jumping, etc. For example, in an action game, it is possible to give an instruction to jump, punch, move a weapon, and so forth. Also, in a roll playing game (RPG) and a simulation RPG, it is possible to instruct to acquire an item, select and determine the weapon and command and so forth.

The select switch 26*e*, menu switch 26*f*, start switch 26*g*, and power supply switch 26*h* are also push button switches. The select switch 26*e* is used for selecting a game mode. The menu switch 26*f* is used for displaying a game menu (menu screen). The start switch 26*g* is used for starting (re-starting) or temporarily posing the game. The power supply switch 26*h* is used for turning on/off a power supply of the video game apparatus 12 by remote control.

In this exemplary embodiment, note that the power supply switch for turning on/off the controller 22 itself is not provided, and the controller 22 is set at on-state by operating any one of the switches or buttons of the input means 26 of the controller 22, and when not operated for a certain period of time (30 seconds, for example) or more, the controller 22 is automatically set at off-state.

The B-trigger switch 26*i* is also the push button switch, and is mainly used for inputting a trigger such as shooting. In a fixed case, the B-trigger switch 26*i* functions in the same way as a normal B-button, and is used for canceling the action determined by the A-button 26*d*.

In addition, an externally expanding connector 22*b* and an indicator 22*c* are provided in the controller 22. The externally expanding connector 22*b* is used for connecting another controller not shown. The indicator 22*c* is constituted of four LEDs, for example, and by lighting any one of the four LEDs, identification information (the controller no.) of the controller 22 is shown.

Figure 3:
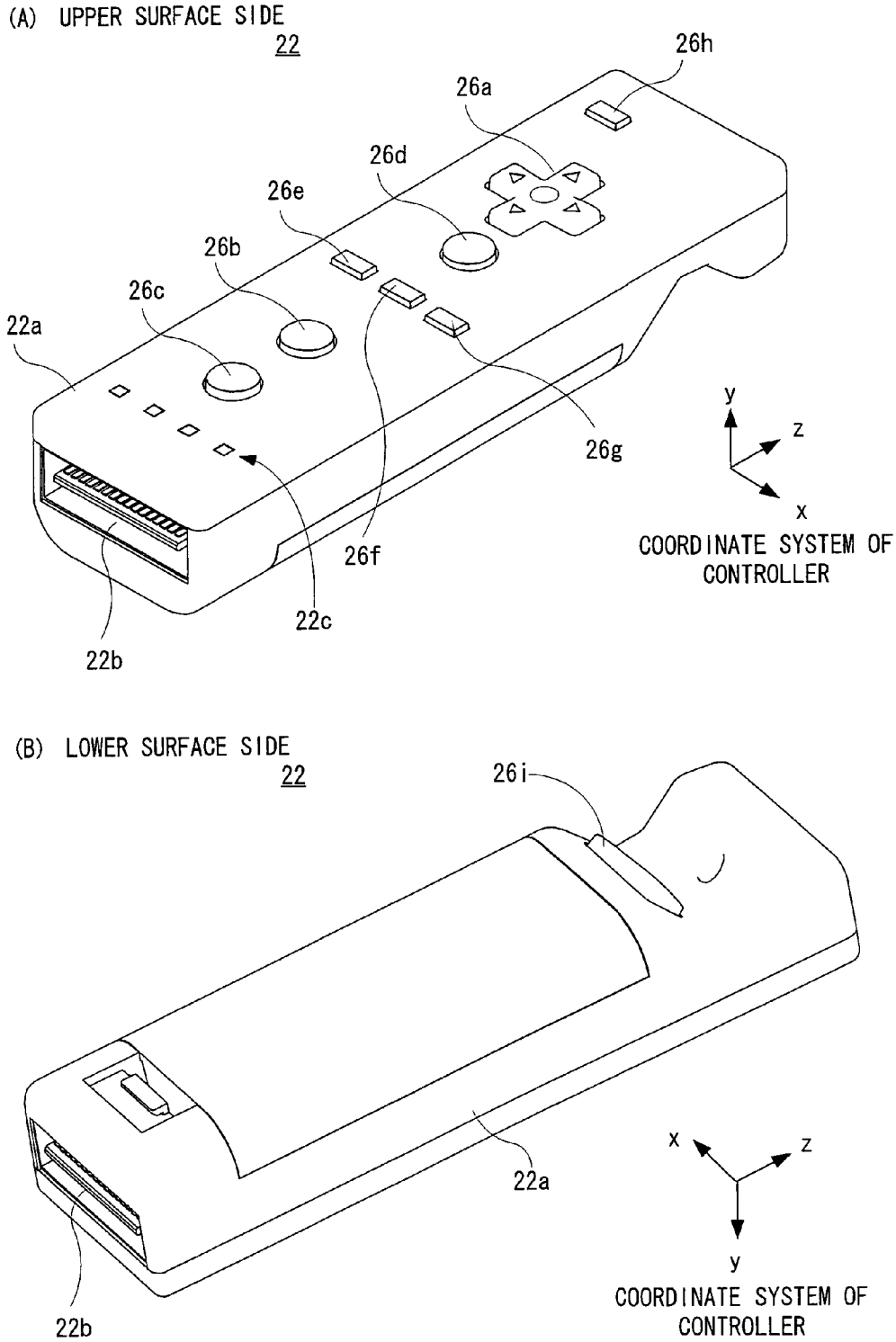
FIG. 3 is a perspective view showing an example of an outer appearance configuration of a controller shown in FIG. 1.

Note that the shape of the controller 22 shown in FIG. 3 and the shape, number and setting position of each input means 26 are simply examples, and needless to say, even if they are suitably modified, the exemplary embodiments can be realized.

Figure 4:
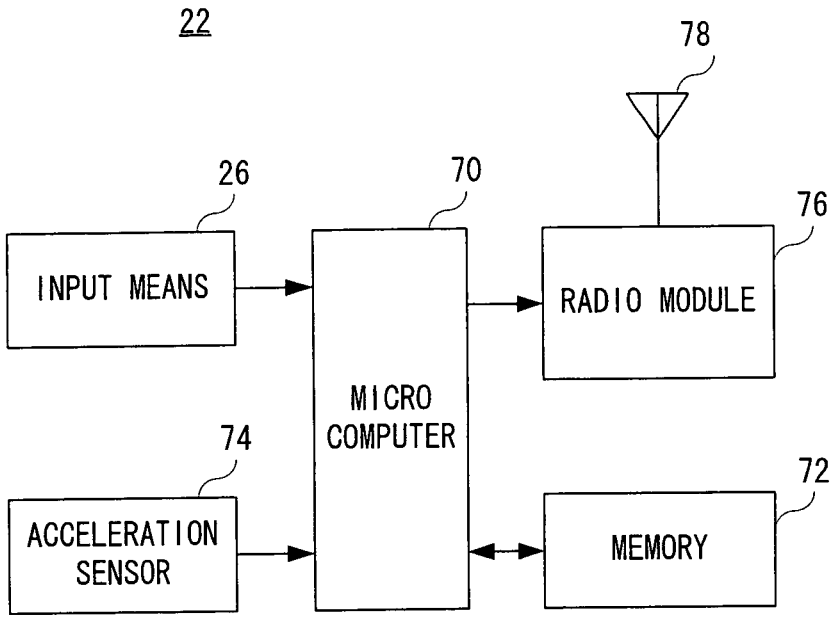
FIG. 4 is a block diagram showing the electric configuration of the controller shown in FIG. 3.

FIG. 4 is a block diagram showing the electric configuration of the controller 22. Referring to FIG. 4, the controller 22 includes a microcomputer 70, and an input means 26, a memory 72, an acceleration sensor 74, and a radio module 76 are connected to the microcomputer 70 by an internal bus (not shown). Moreover, an antenna 78 is connected to the radio module 76.

Further, although not shown, the above-described expanding connector 22*b* and the indicator 22*c* (LED) are also connected to the microcomputer 70 via an interface or a driver.

The microcomputer 70 is in charge of an overall control of the controller 22, and transmits (inputs) information (input information) inputted by the input means 26 and the acceleration sensor 74 as input information data, to the video game apparatus 12 via the radio module 76 and the antenna 78. At this time, the microcomputer 70 uses the memory 72 as a working area or a buffer area.

An operation signal (operation data) from the aforementioned input means 26 (26*a* to 26*i*) is inputted in the microcomputer 70, and the microcomputer 70 stores the operation data once in the memory 72.

Moreover, the acceleration sensor 74 detects each acceleration in directions of three axes of vertical direction (y-axial direction shown in FIG. 3), lateral direction (x-axial direction shown in FIG. 3), and forward and rearward directions (z-axial direction shown in FIG. 3). The acceleration sensor 74 is typically an acceleration sensor of an electrostatic capacity type, but the acceleration sensor of other type may also be used. As is clarified from FIG. 3(A) and FIG. 3(B), in this exemplary embodiment, a vertical upper direction of the upper surface of the controller 22 is selected to be a positive direction of the y-axis, and the right direction of the controller 22 which is vertical to the y-axis is selected to be the positive direction of the x-axis, and a direction which is vertical to the x-axis and the y-axis corresponding to a longitudinal direction of the controller 22 and directed toward the cross switch 26*a* from the X-button 26*b* is selected to be the positive direction of the z-axis.

For example, the acceleration sensor 74 detects the accelerations (ax, ay, az) in each direction of x-axis, y-axis, z-axis for each first predetermined time (such as 200 msec), and inputs the data of the acceleration (acceleration data) thus detected in the microcomputer 70. For example, the acceleration sensor 74 detects the acceleration in each direction of the axes in a range from −2.0 g to 2.0 g (g indicates a gravitational acceleration. The same thing can be said hereafter.). The microcomputer 70 detects the acceleration data given from the acceleration sensor 74 for each second predetermined time (for example, 1 frame: each screen update unit time (1/60 sec)), and stores it in the memory 72 once. The microcomputer 70 generates input information data including at least one of the operation data and acceleration data, and transmits the input information data thus generated to the video game apparatus 12 for each third predetermined time (1 frame).

In this exemplary embodiment, although omitted in FIG. 3, the acceleration sensor 74 is provided inside the housing 22*a* and in the vicinity of a place where the cross key 26*a* is arranged.

The radio module 76 modulates a carrier of a predetermined frequency by the input information data, by using a technique of Bluetooth (registered trademark), for example, and emits its weak radio wave signal from the antenna 78. Namely, the input information data is modulated to the weak radio wave signal by the radio module 76 and transmitted from the antenna 78 (controller 22). The weak radio wave signal thus transmitted is received by the reception unit 24 loaded on the aforementioned video game apparatus 12. The weak radio wave thus received is subjected to demodulating and decoding processing, thus making it possible for the video game apparatus 12 (CPU 36) to acquire the input information data from the controller 22. Then, the CPU 36 performs game processing, following the input information data and the program (game program).

Figure 5:
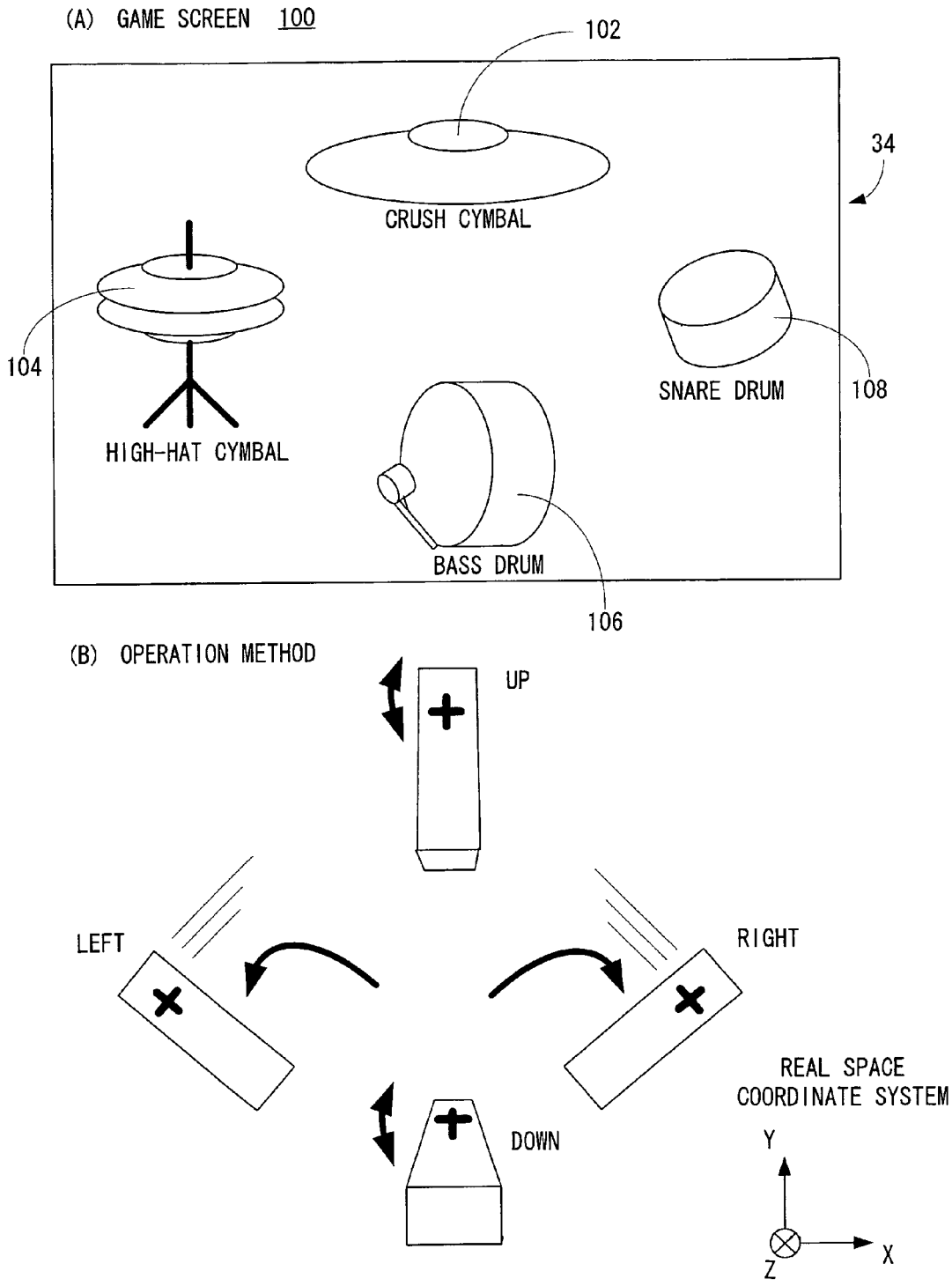
FIG. 5 is an illustrative view showing an example of a game screen displayed on a monitor shown in FIG. 2, and an illustrative view for explaining an operating method of the controller.

FIG. 5(A) shows an example of a performance screen (game screen) 100 displayed on the monitor 34. Also, FIG. 5(B) shows an example of the operation method of the controller 22 when the musical instrument is played in a pseudo manner by observing the game screen 100 shown in FIG. 5(A). Namely, the player operates the controller 22 by being guided by the game screen 100.

As shown in FIG. 5(A), images 102, 104, 106, 108 of four musical instruments are displayed on the game screen 100. For example, an image 102 of a crush cymbal is displayed in an upper part of the game screen 100. Also, an image 104 of a high-hat cymbal is displayed in the left part of the game screen 100. Further, an image 106 of a bass drum is displayed in a lower part of the game screen 100. Still further, an image 108 of a snare drum is displayed in the right part of the game screen 100.

The player plays (hits) the musical instrument displayed on the game screen 100, by swinging the controller 22 in the lateral direction (right direction or left direction) or the vertical direction (upper direction or lower direction). However, in this exemplary embodiment, by using the controller 22, the musical instrument displayed on the game screen 100 is hit. Therefore, in the vertical direction, it is so determined that the musical instrument is hit only when the controller 22 swings downward. When the controller 22 is vertically swung, a determination method of determining whether or not it swings upward or it swings downward will be explained later in detail.

For example, when the player swings the controller 22 in the right direction, the snare drum (image 108) can be hit. Also, when the player swings the controller 22 in the left direction, the hi-hat cymbal (image 104) can be hit. Further, when the player swings the controller 22 downward, and stops the swinging motion at a relatively high position (upper part), the crush cymbal (image 102) can be hit. Still further, when the player swings the controller 22 downward, and stops the swinging motion in the vicinity of a horizontal position or at the position lower than the horizontal position (lower part), the bass drum (image 106) can be hit.

Figure 6:
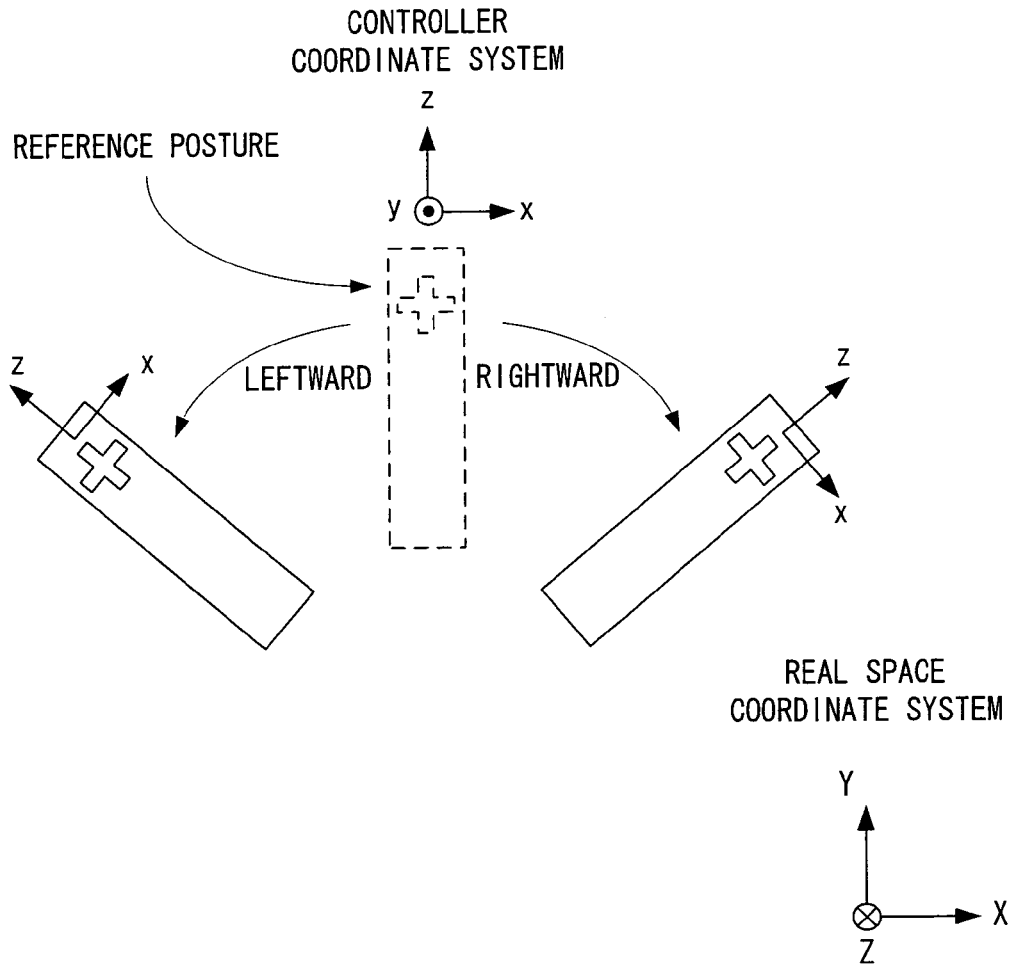
FIG. 6 is an illustrative view for explaining a swinging motion of the controller in a lateral direction.

The operation method (swinging motion) and the determination method of the swinging direction of the controller 22 will be explained with reference to FIG. 6 to FIG. 10. As shown in FIG. 6, when the controller 22 swings in the lateral direction (right and left), the direction of the upper side of the controller 22 is set in a minus direction of the Z-axis of a real space coordinate system. Namely, the upper surface of the controller 22 is directed in the same direction as the game screen 100 (monitor 34) as shown in FIG. 5(B). Accordingly, as shown in FIG. 6, when the controller 22 swings in the lateral direction, the controller 22 is rotated with the Z-axis as a center in the XY plane of the real space coordinate system. Specifically, when the controller 22 swings in the right direction, the controller 22 is inclined so that an angle formed by a plus direction of the z-axis of the controller 22 and the plus direction of the X-axis of the real space coordinate system becomes small. Meanwhile, when the controller 22 swings in the left direction, the controller 22 is inclined so that the angle formed by the plus direction of the z-axis of the controller 22 and the minus direction of the X-axis of the real space coordinate system becomes small.

Here, as shown in FIG. 6, in this exemplary embodiment, the plus direction of the x-axis of the controller 22 coincides with the plus direction of the X-axis of the real space coordinate system, and the plus direction of the y-axis of the controller 22 coincides with the minus direction of the Z-axis of the real space coordinate system, and the plus direction of the z-axis of the controller 22 coincides with the plus direction of the Y-axis of the real space coordinate system. This case is defined as a reference posture of the controller 22. However, in the reference posture, the direction (posture) of the controller 22 is determined, so that the cross key 26*a* faces upward. In addition, in this exemplary embodiment, an explanation is given to a case of swinging the controller 22 from the reference posture for convenience. However, actually, the controller 22 is not required to swing from the reference posture. The same thing can be said hereafter.

Figure 7:
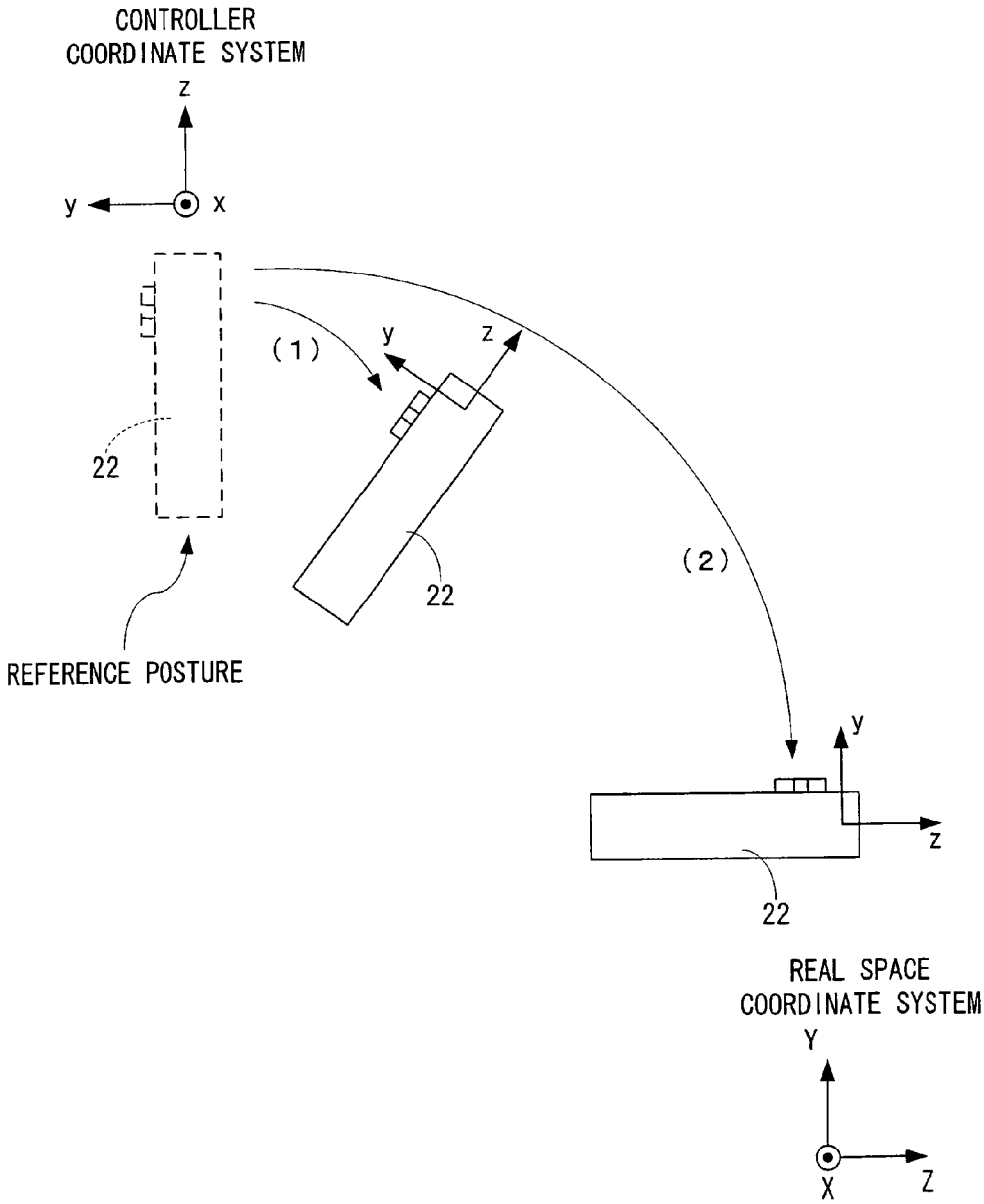
FIG. 7 is an illustrative view for explaining a determination method of a swinging direction when the controller swings in the lateral direction.

In addition, as shown in FIG. 7, when the controller 22 is swung downward, the controller 22 is rotated around the X-axis in an YZ plane in the real space coordinate system. FIG. 7(1) shows a state in which the controller 22 is swung downward and stopped in a relatively high position (upper part). Namely, the controller 22 is stopped at a position where the z-axis is slightly inclined to the Y-axis of the real space coordinate system. In this case, as described above, the crush cymbal displayed in the upper part of the game screen 100 can be hit. Meanwhile, FIG. 7(2) shows a state in which the controller 22 is swung downward and stopped at a horizontal position. Namely, the controller 22 is stopped at the position where the z-axis is inclined until the z-axis becomes parallel to the Z-axis of the real space coordinate system. In this case, as described above, the bass drum displayed in a lower part of the game screen 100 can be hit.

FIG. 8(A1) shows the change of the controller 22 in an axial direction, when the controller 22 is swung in the right direction. As described above, when the controller 22 is swung in the right direction, the controller 22 is inclined, so that the angle formed by the plus direction of the z-axis of the controller 22 and the plus direction of the X-axis of the real space coordinate system becomes small. However, FIG. 8(A1) shows the change of the controller 22 in the axial direction when the controller 22 is swung in the right direction from the reference posture. In this case, accelerations ax and az that appear on the x-axis and y-axis of the controller 22 change as shown in FIG. 8(A2). Namely, the acceleration az corresponding to the gravitational acceleration g in the minus direction of the z-axis appears in the controller 22, before the controller 22 is swung. Then, after the controller 22 is swung, the acceleration ax and the acceleration az appear, which are generated after decomposition of the gravitational acceleration g in accordance with the inclination of the controller 22 at the time of end of the swinging motion. However, as is clarified from FIG. 8(A1), when the controller 22 is swung in the right direction, the y-axis of the controller 22 perpendicularly crosses the Y-axis of the real space coordinate system where gravitational force works, thus allowing no acceleration to appear in the y-axial direction (ay=0). The same thing can be said for a case of the controller 22 is swung in the left direction.

Also, FIG. 8 (B1) shows the change of the controller 22 in the axial direction when the controller 22 is swung in the left direction. As described above, when the controller 22 is swung in the left direction, the controller 22 is inclined, so that the angle formed by the plus direction of the z-axis of the controller 22 and the minus direction of the X-axis of the real space coordinate system becomes small. However, FIG. 8 (A1) shows the change of the controller 22 in the axial direction, when the controller 22 is swung in the left direction from the reference posture. In this case, the accelerations ax and az that appear on the x-axis and the y-axis of the controller 22 change as shown in FIG. 8 (B2). Namely, before the controller 22 is swung, the acceleration az corresponding to the gravitational acceleration g appears in the minus direction of the z-axis. Then, after the controller 22 is swung, in the minus direction of the x-axis and the minus direction of the z-axis, the acceleration ax and the acceleration az appear, which are generated after decomposition of the gravitational acceleration g in accordance with the inclination of the controller 22 at the time of end of the swinging motion.

Accordingly, it could be determined whether or not the controller 22 is swung in the right direction or the left direction, by a numerical value of the acceleration ax of the x-axis or its signs (plus and minus) at the time of end of the swinging motion, after the end of the swinging motion of the controller 22 is detected.

However, as described above, according to this exemplary embodiment, an operation is so performed as if the musical instrument is hit by the controller 22. Therefore, when the swinging motion in the right direction or the left direction is determined only by the numerical value of the acceleration ax in the x-axial direction or the signs thereof at the time of end of the swinging motion, there is a possibility that hitting operation is erroneously performed, even though a player does not perform the hitting operation. This is because, for example, even when the controller 22 is slowly inclined to the right direction or the left direction, the acceleration ax appears in the x-axial direction of the controller 22 by the gravitational force g. Also, this is because erroneous determination that mere unintentional motion is judged to be the hitting operation (swinging motion) must be prevented.

Therefore, according to this exemplary embodiment, the swinging motion in the right direction or the left direction is judged in accordance with the value of the acceleration ax in the x-axial direction at an initial period or in the middle of the swinging motion. Specifically, in consideration of the gravitational acceleration g, when the acceleration ax in the direction of the x-axis becomes a first threshold value (for example, 1.2 g) or more, the swinging motion is judged to be in the right direction. Also, similarly, in consideration of the gravitational acceleration g, when the acceleration ax in the direction of the x-axis becomes a second threshold value (for example, −1.2 g) or less, the swinging motion is judged to be in the left direction.

Although a detailed explanation is omitted, when the controller 22 is swung in the right direction and the left direction, the acceleration due to a centrifugal force appears in the direction of the z-axis. However, the same thing can be said for the case that the controller 22 is swung in the vertical direction, and therefore the direction of swinging the controller 22 can not be determined by the acceleration az in the z-axial direction.

Also, although not shown, when the controller 22 is swung in the right direction or in the left direction, the end of swinging is judged by whether or not an increase or decrease of the acceleration ax is ended. Then, at the time of end of swinging the controller 22, it is so determined that the musical instrument is hit, and the sound of the musical instrument is outputted in accordance with the direction of swinging the controller 22 and the display on the game screen 100 is updated.

FIG. 9 (A1) shows the change of the controller 22 in the axial direction, when the controller 22 is swung downward and stopped in the upper part. Namely, as shown in FIG. 7 (1), the controller 22 is swung so as to rotate around the X-axis of the real space coordinate system from the reference posture, and is stopped at the position where the z-axis is slightly inclined to the Y-axis of the real space coordinate system. In this case, the accelerations ay and az that appear on the y-axis and the z-axis of the controller 22 change as shown in FIG. 9 (A2). Namely, before the controller 22 is swung, the acceleration az corresponding to the gravitational acceleration g appears in the minus direction of the z-axis. Then, after the controller 22 is swung, the acceleration ay and the acceleration az appear in the minus direction of the y-axis and the minus direction of the z-axis, the acceleration ay and the acceleration az being generated after decomposition of the gravitational acceleration g in accordance with the inclination of the controller 22 at the time of end of the swinging motion. However, as is clarified from FIG. 9 (A1), when the controller 22 is swung downward, the x-axis of the controller 22 perpendicularly crosses the Y-axis of the real space coordinate system where the gravitational force works, thus allowing no acceleration to appear in the x-axial direction (ax=0).

Also, FIG. 9 (B1) shows the change of the controller 22 in the axial direction when the controller 22 is swung downward and is stopped at the horizontal position. Namely, as shown in FIG. 7 (2), the controller 22 is swung so as to rotate around the X-axis of the real space coordinate system from the reference posture, and is stopped at the position where the z-axis is inclined until the z-axis becomes parallel to the Z-axis of the real space coordinate system. In this case, the accelerations ay and az that appear on the y-axis and the z-axis of the controller 22 change as shown in FIG. 9 (B2). Namely, before the controller 22 is swung, the acceleration az corresponding to the gravitational acceleration g appear in the controller 22 in the minus direction of the z-axis. Then, after the controller 22 is swung, the acceleration ay corresponding to the gravitational acceleration g appears in the minus direction of the y-axis. However, the z-axis of the controller 22 perpendicularly crosses the Y-axis of the real space coordinate system where the gravitational force works, and therefore the acceleration does not appear in the z-axial direction (az=0).

Here, when the controller 22 is swung downward, differently from the case that the controller 22 is swung in the lateral direction, the controller 22 is swung in the same direction, even in either case of stopping the controller 22 relatively at the upper part, or stopping the controller 22 in the vicinity of the horizontal position or at the lower part. Therefore, in order to judge whether or not the controller 22 is stopped relatively at the upper part or stopped in the vicinity of the horizontal position or at the lower part, a determination method used in the case that the controller 22 is swung in the lateral direction can not be utilized. Namely, for example, it is difficult to perform the above-described judgment by only the acceleration ay in the y-axial direction.

Therefore, according to this exemplary embodiment, when the controller 22 is swung downward, the end of swinging is determined, and in accordance with the posture of the controller 22 at the time of end of swinging, it is judged whether or not the controller 22 is stopped relatively at the upper part or is stopped in the vicinity of the horizontal position or at the lower part. Specifically, as is clarified by comparing FIG. 9 (A2) and FIG. 9 (B2), the posture is determined based on the acceleration az in the z-axial direction at the time of end of swinging the controller 22. Namely, as shown in FIG. 9 (A2), when the controller 22 is stopped relatively at the upper part, the acceleration az by the gravitational force is largely appears in the minus direction. Meanwhile, as shown in FIG. 9 (B2), when the controller 22 is stopped at the horizontal position, the acceleration az that appears in the minus direction of the z-axis is larger than the case shown in FIG. 9 (A2) in its stop state. Although not shown, when the controller 22 is stopped at the position where it is swung further downward than the horizontal position, the acceleration az appears in the plus direction of the z-axis. Namely, the acceleration az becomes further larger.

Therefore, according to this exemplary embodiment, when the controller 22 is swung downward, a third threshold value (−0.5 g, for example) is set, and by using the third threshold value, the stop position of the controller 22 is judged. Specifically, the acceleration az in the z-axial direction at the time of stopping the controller 22 is detected. Then, when the acceleration az is smaller than the third threshold value, it is so determined that the controller 22 is stopped relatively at the upper part. Conversely, when the acceleration az is equal to the third threshold value or more, it is so determined that the controller 22 is stopped in the vicinity of the horizontal position or at the lower part.

It should be noted that whether or not the controller 22 is swung in the vertical direction can be known by the change of the acceleration in the y-axial direction.

Figure 10:
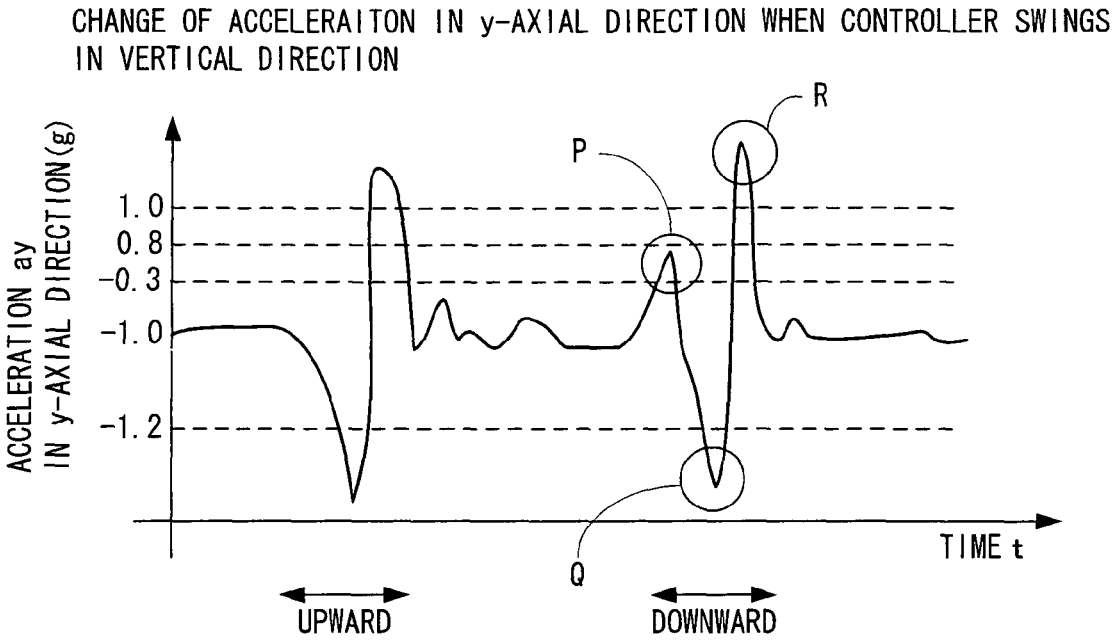
FIG. 10 is a graph showing a change per time of the acceleration in a direction of y-axis when the controller swings in the vertical direction.

In addition, FIG. 10 is a graph showing the change rate per time of the acceleration ay that appears in the y-axial direction, when the controller 22 is swung from upside to downside (downward), after the controller 22 is swung from downside to upside (upward). This graph is obtained when a real machine of the controller 22 shown in this exemplary embodiment is actually swung up and down (vertical direction).

As is clarified from the graph shown in FIG. 10, the change rate per time of the acceleration ay that appears in the y-axial direction shows that after a negative peak value appears, a positive peak value appears, in either case that the controller 22 is swung upward and the controller 22 is swung downward. Namely, the above both cases are similar to each other.

Here, as described above, according to this exemplary embodiment, the controller 22 is swung so as to hit the musical instrument displayed on the game screen 100. Accordingly, when the controller 22 is swung upward, the player feels discomfort when the sound of the musical instrument rings. Therefore, in this exemplary embodiment, when the controller 22 is swung in the vertical direction, the sound of the musical instrument rings only when the controller 22 is swung downward.

According to this exemplary embodiment, when a local peak value shown by a circle P of FIG. 10 is detected, it is so determined that the controller 22 is swung downward. Thereafter, when the negative peak value shown by a circle Q is detected, the end of swinging the controller 22 is judged.

Specifically, after the acceleration ay of the controller 22 in the y-axial direction becomes −0.3 or more, the CPU 36 determines whether or not the negative peak value shown by the circle Q is detected without exceeding a predetermined value (0.8 g). Here, when the acceleration ay exceeds the predetermined value without detecting the negative peak value, it is so determined that the controller 22 has an upward swinging motion, because there is not peak value shown by the circle P. Meanwhile, when the negative peak value is detected, it is so determined that the controller 22 has a downward swinging motion.

Also, the negative peak value is detected by using the acceleration ay of the past three frames including the latest (current frame) acceleration ay. Specifically, it is so assumed that values of three accelerations ay are selected to be α, β, γ (they are all negative values), and are detected in the order of α, β, γ. Namely, γ is the acceleration ay of the current frame. At this time, when the following Equation 1 is satisfied, the negative peak value is detected.

$$\alpha-\beta>0 \text{ and } \gamma-\beta>0 \qquad \text{[Equation 1]}$$

In this exemplary embodiment, when the negative peak value shown by the circle Q is detected, the end of swinging the controller 22 is determined. However, the exemplary embodiment is not limited thereto, and it may be so constituted that when the peak value shown by a circle R is detected, the end of swinging the controller 22 is judged. Which case is to be selected is a matter of arbitrary selection by a developer or a designer.

Figure 11:
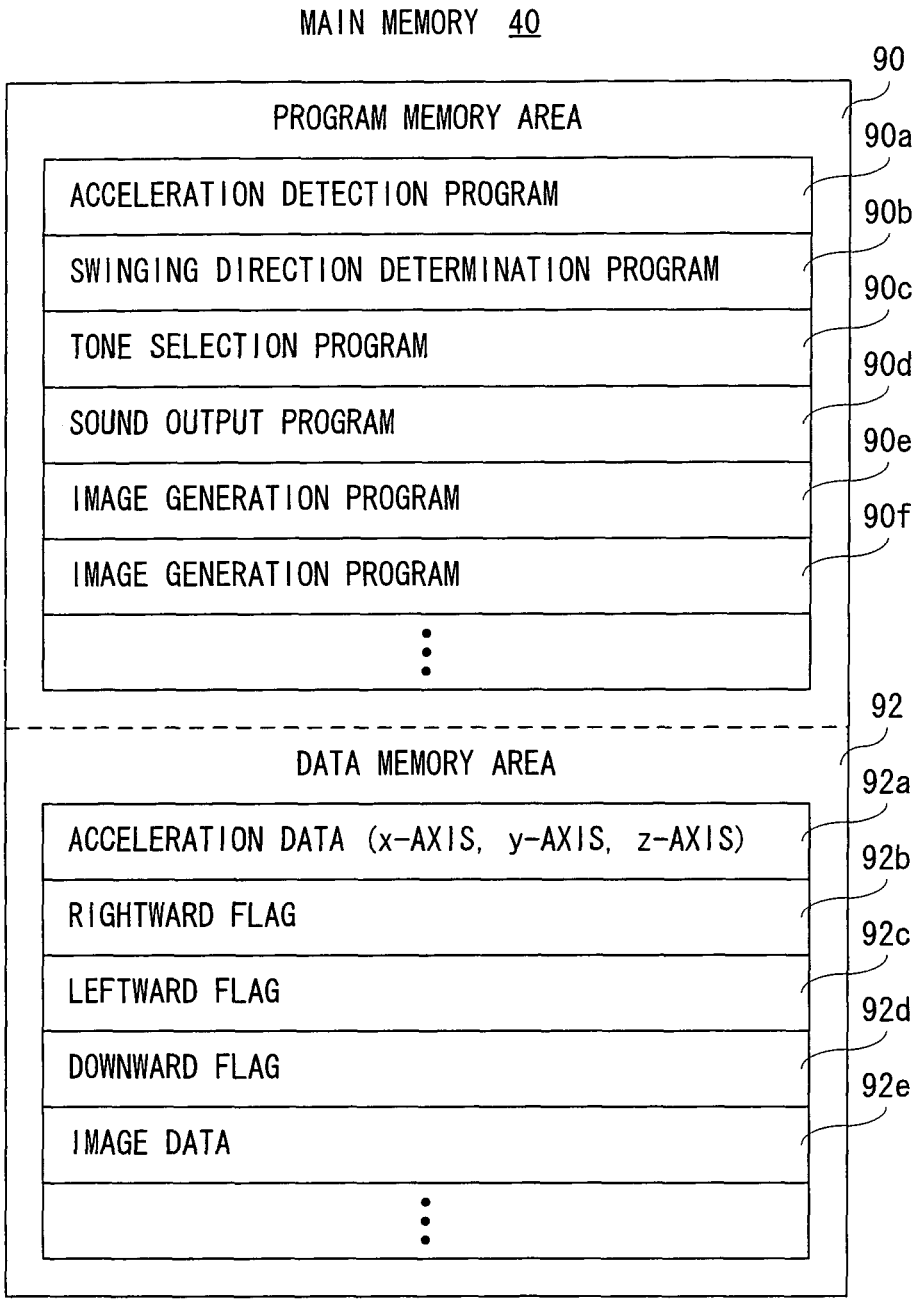
FIG. 11 is an illustrative view showing an example of a memory map of a main memory shown in FIG. 2.

FIG. 11 is a memory map of a main memory 40 shown in FIG. 2. Referring to FIG. 11, the main memory 40 includes a program memory area 90 and a data memory area 92. A music performance program (game program) is stored in the program memory area 90, and this music performance program is constituted by an acceleration detection program 90*a*, a swinging direction determination program 90*b*, a tone selection program 90*c*, a sound output program 90*d*, an image generation program 90*e*, and an image display program 90*f*, etc.

The acceleration detection program 90*a* is a program for detecting acceleration data from input information data inputted from the controller 22, and storing (temporarily storing) the acceleration data thus detected in the data memory area 92, according to a time series. The swinging direction determination program 90*b* is a program for determining the swinging direction of the controller 22 based on the acceleration data. In addition, the swinging direction determination program 90*b* executes establishment (on) and non-establishment (off) of each of a rightward flag 92*b*, a leftward flag 92*c* and a downward flag 92*d* as will be described later, on determining the swinging direction.

The tone selection program 90*c* is program for determining (hitting determination) the musical instrument hit by the controller 22, i.e. images (102, 104, 106, 108) and selecting the tone of the musical instrument in accordance with a determination result. The sound output program 90*d* is a program for outputting the sound of the tone selected by following the tone selection program 90*c*. Moreover, the sound output program 90*d* outputs the sound like BGM and an orchestra as needed.

In addition, although not shown, the data (sound data) corresponding to the sound like BGM and the orchestra is stored in the data memory area 92.

The image generation program 90*e* is a program for generating a game image including an object like the musical instrument, by using image data 92*f* as will be described later. Also, the image generation program 90*e* causes the images (102, 104, 106, 108) of the musical instruments to change by following animation data. The image display program 90*f* is the program for displaying (outputting) on a monitor 34 the game image generated by following the image generation program 90*e*.

In addition, although not shown, the program such as a backup program is also stored in the program memory area 90. The backup program is the program for saving intermediate data and result data of a musical performance game in the memory card 30.

The acceleration data 92*a*, rightward flag 92*b*, leftward flag 92*c*, downward flag 92*d* and image data 92*e*, etc. are stored in the data memory area 92.

The acceleration data 92*a* is numerical data of the accelerations (ax, ay, az) that appear on each axis (x-axis, y-axis, and z-axis) fixedly determined in the controller 22, and as described above, is stored according to the time series, by following the acceleration detection program 90*a*. However, in this exemplary embodiment, the accelerations ax, ay, az are expressed by using the gravitational acceleration g. The rightward flag 92*b* is a flag for determining whether or not the controller 22 is swung in the right direction, and is turned on/off by following the swinging direction determination program 90*b*. For example, the rightward flag 92*b* (the same thing can be said for other flags 92*c* and 92*d*) is constituted by a register of 1 bit, and when the flag is turned on, data value "1" is set in the register, and when the flag is turned off, data value "0" is set in the register. For example, the rightward flag 92*b* is turned on when the swinging direction of the controller 22 is determined to be the right direction, and is turned off otherwise.

The leftward direction flag 92*b* is a flag for determining whether or not the controller 22 is swung in the left direction, and is turned on/off by following the swinging direction determination program 90*b*. For example, the leftward flag 92*b* is turned on when the swinging direction of the controller 22 is determined to be the left direction, and is tuned off otherwise. The downward flag 92*d* is a flag for determining whether or not the controller 22 is swung downward, and is tuned on/off by following the swinging direction determination program 90*b*. For example, the downward flag 92*d* is turned on when the swinging direction of the controller 22 is determined to be the downward, and is turned off otherwise.

As described above, the image data 92*e* is the data (polygon data and texture data, etc.) for generating the game image. Also, the image data 92*e* includes the animation data for performing animation display of an object (such as musical instrument).

Although not shown, other data and other flags are stored in the data memory area 92.

Figure 12:
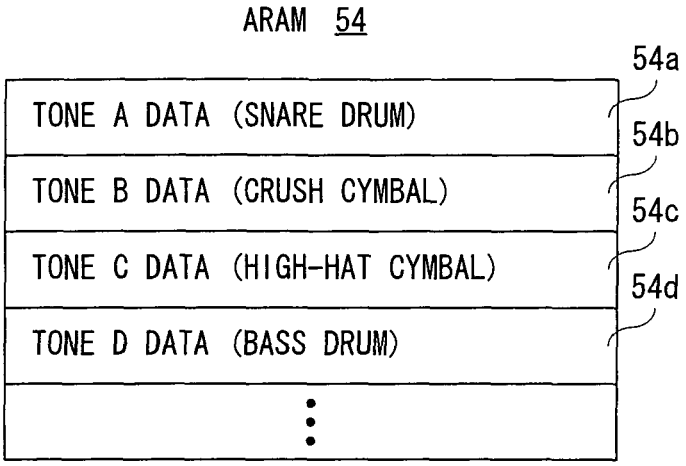
FIG. 12 is an illustrative view showing an example of the memory map of ARAM shown in FIG. 2.

FIG. 12 shows the memory map of ARAM 54 shown in FIG. 2. The ARAM 54 stores the tone data (sound wave data). For example, the tone data is read from the optical disk 18, written in a predetermined area of the main memory 40 once, and thereafter, all of them are simultaneously or partially and sequentially written in the ARAM 54. As shown in FIG. 12, the ARAM 54 stores tone A data 54*a* for the tone of a snare drum, tone B data 54*b* for the tone of a crush cymbal, tone C data 54*c* for the tone of a high-hat cymbal, and tone D data 54*d* for the tone of a bass drum, etc. Accordingly, following the aforementioned tone output program 90*c*, the CPU 36 reads the tone data 54*a*, 54*b*, 54*c*, 54*d*, . . . selected by following the tone selection program 90*c*, and gives the tone data 54*a*, 54*b*, 54*c*, 54*d*, . . . thus read to DSP 52. The DSP 52 applies predetermined processing to the tone data 54*a*, 54*b*, 54*c*, 54*d*, under an instruction of the CPU 36, and outputs it to the speaker 34*a* through the main memory 40 and the audio I/F62.

Figure 13:
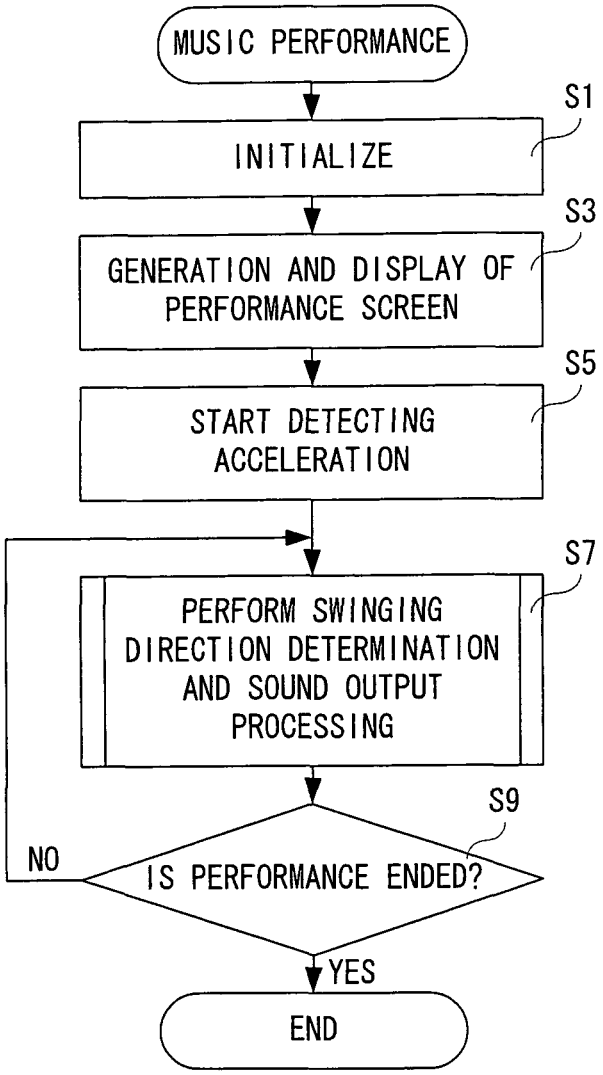
FIG. 13 is a flowchart showing a music performance processing of a CPU shown in FIG. 2.

Specifically, the CPU 36 as shown in FIG. 2 executes music performance processing by following the flowchart shown in FIG. 13. As shown in FIG. 13, when the CPU 36 starts the music performance processing, initialization processing is executed in a step S1. Namely, the CPU 36 turns off each flag 92*b*, 92*c*, 92*d*, and clears a buffer area. In a next step S3, a performance screen, i.e. the game screen 100 is generated, and displayed on the monitor 34. Subsequently, detecting the acceleration is started in a step S5. Namely, the CPU 36 detects the acceleration data 92*a* from the input information data inputted from the controller 22, and starts to store the acceleration data 92*a* thus detected in the data memory area 92. Accordingly, although not shown, the acceleration data 92*a* is stored in the data memory area 92 according to the time series during executing the music performance processing.

In a subsequent step S7, a swinging direction determination and sound output processing as will be described later (see FIG. 14 to FIG. 16) is executed. Then, in a step S9, the CPU 36 determines whether or not the performance is ended. Here, the CPU 36 determines whether or not an end instruction to the music performance is given from the player. However, in this exemplary embodiment, even when a state in which the input information data is not inputted from the controller 22 continues for a predetermined period of time, it is so determined that the music performance is ended. When the determination in the step S9 shows "NO", namely, when the performance is not ended, the processing is returned to the step S7 as it is. Meanwhile, when determination in the step S9 shows "YES", namely, when the performance is ended, the music performance processing is ended.

Figure 14:
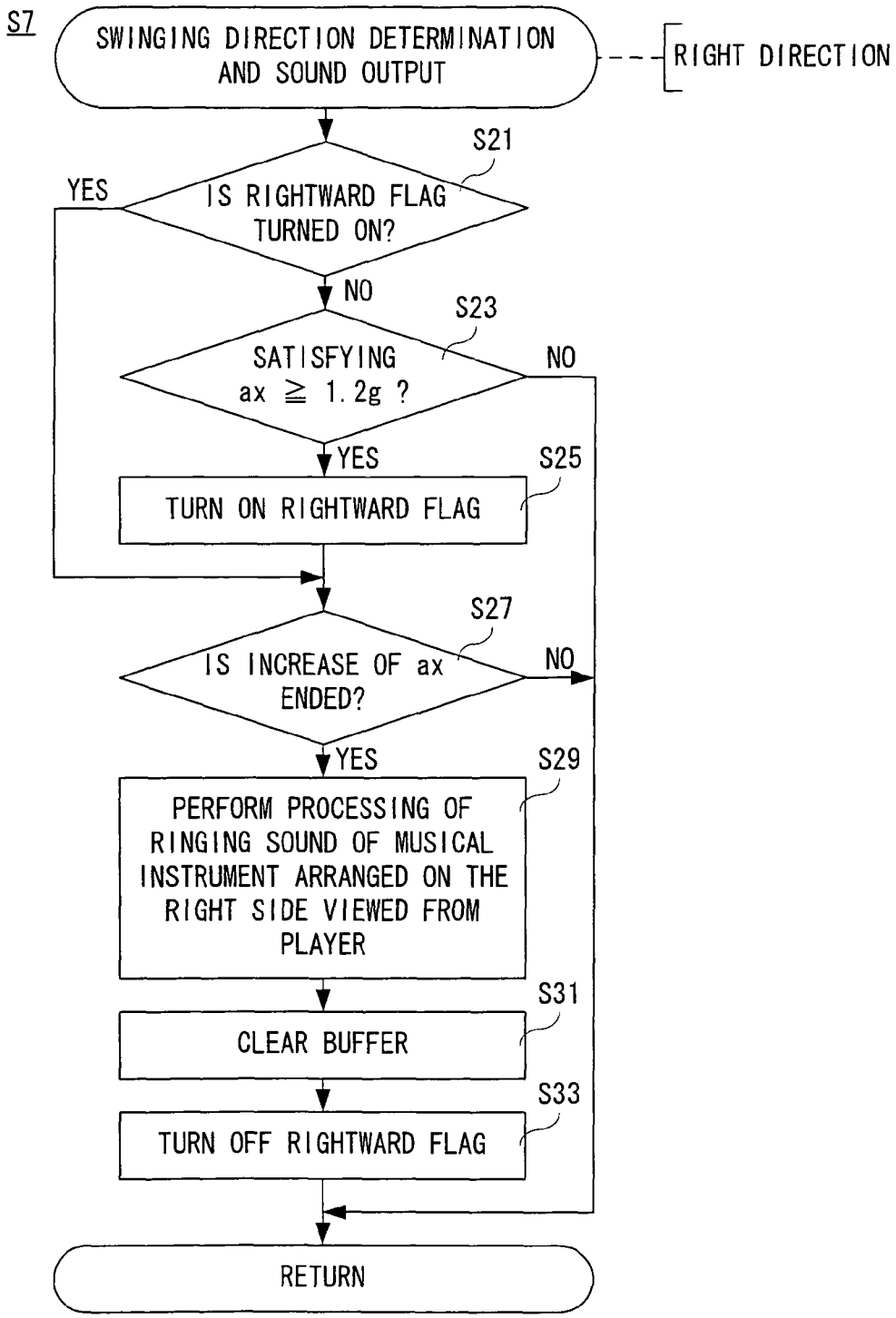
FIG. 14 is a flowchart showing a swinging direction determination and a sound output processing for a right direction of the CPU shown in FIG. 2.
Figure 15:
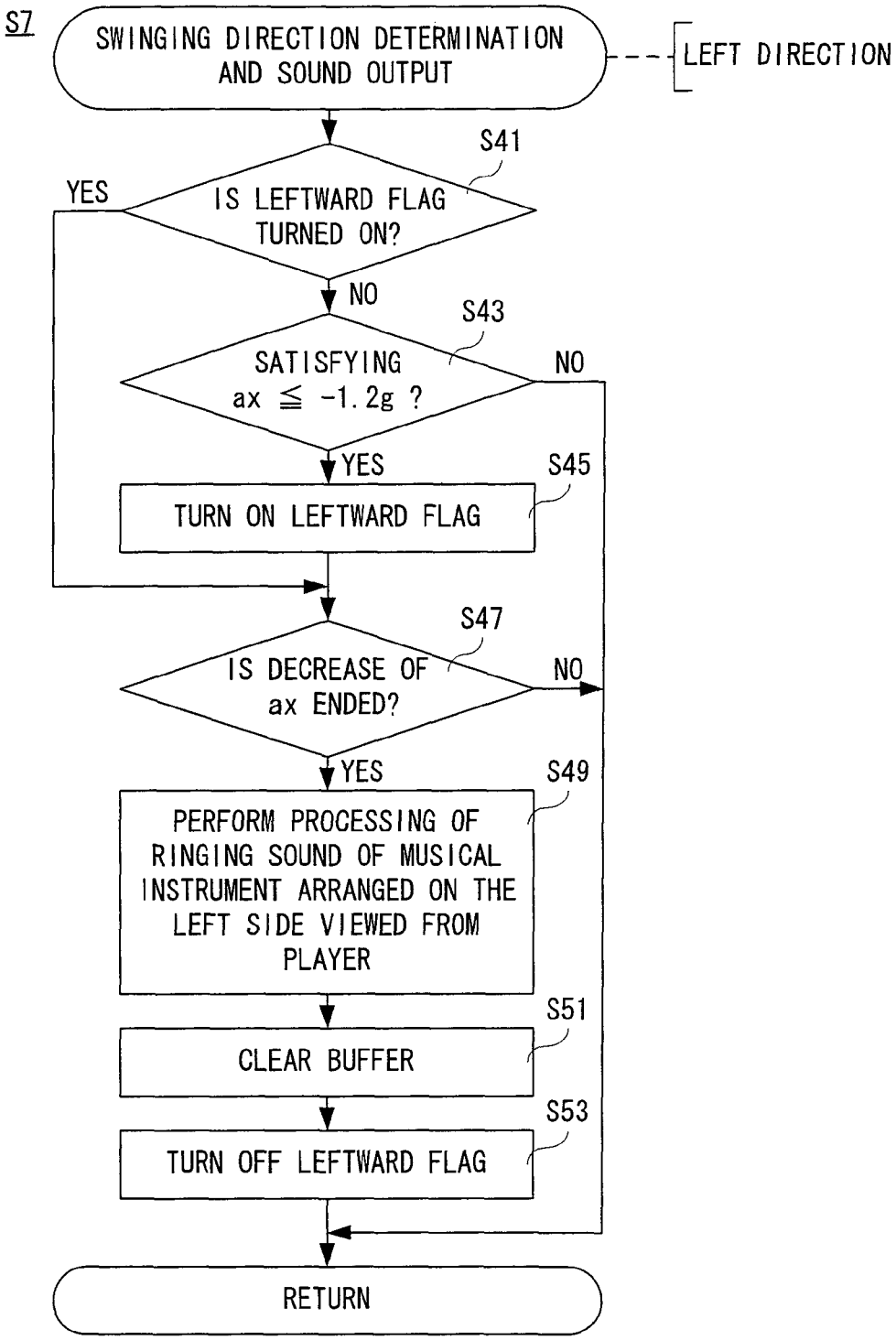
FIG. 15 is a flowchart showing the swinging direction determination and the sound output processing for a left direction of the CPU shown in FIG. 2.
Figure 16:
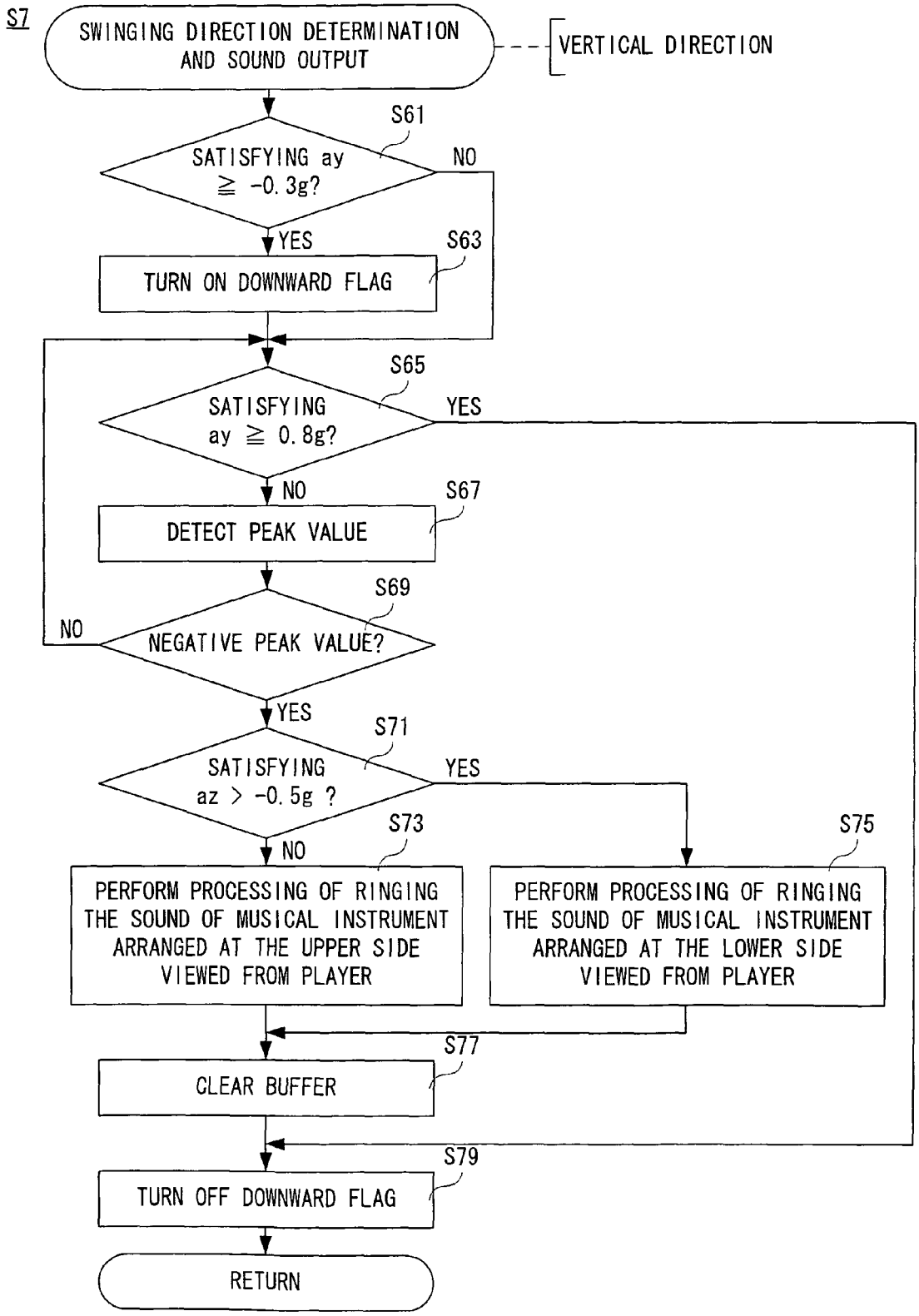
FIG. 16 is a flowchart showing the swinging direction determination and the sound output processing for the vertical direction of the CPU shown in FIG. 2.

The swinging direction determination and the sound output processing shown in the step S7 of FIG. 13 is executed in parallel (by multitasking) by following the flowchart shown in each FIG. 14 to FIG. 16. FIG. 14 is a flowchart showing the swinging direction determination and the sound output processing for determining whether or not the controller 22 takes a rightward swinging motion and outputs the sound corresponding to the determination result.

As shown in FIG. 14, when the swinging direction determination and the sound output processing are started, the CPU 36 determines whether or not the rightward flag 92*b* is turned on in a step S21. When the determination in the step S21 shows "YES", namely, when the rightward flag 92*b* is turned on, the processing proceeds to a step S27 as it is. However, when the determination in the step S21 shows "NO", namely, when the rightward flag 92*b* is turned off, the CPU 36 determines whether or not the acceleration ax of the controller 22 in the x-axial direction is 1.2 g or more in a step S23.

When the determination in the step S23 shows "NO", namely, when the acceleration ax is less than 1.2 g, it is so determined that the controller 22 is not swung in the right direction, and the processing is returned to the performance processing shown in FIG. 13. Meanwhile, when the determination in the step S23 shows "YES", namely, when the acceleration ax is 1.2 g or more, it is so determined that the controller 22 is swung in the right direction, and the rightward flag 92*b* is turned on in a step S25, and the processing proceeds to the step S27.

Since there is no case of simultaneously turning on two or more of the rightward flag 92*b*, leftward flag 92*c*, and the downward flag 92*d*, the CPU 36 is designed to turn off all the other flags (92*c* and 92*d*) when turning on the rightward flag 92*b*. The same thing can be said for the other flags.

In the step S27, the CPU 36 determines whether or not the increase of the acceleration ax of the controller 22 in the x-axial direction is ended. Here, the CPU 36, for example, detects the acceleration ax up to the current frame from the frame that precedes several frames from it, and determines whether or not the acceleration ax is changed (increased). When the acceleration ax is increased, it is determined that the swinging motion is not ended. However, when the acceleration ax is not increased, namely, when the acceleration ax is a fixed value or approximately the fixed value, it is determined that the swinging motion is ended.

When the determination in the step S27 shows "NO", namely, when the increase of the acceleration ax is not ended, the processing is returned to the music performance processing as it is. Meanwhile, when the determination in the step S27 shows "YES", namely, when the increase of the acceleration ax is ended, it is determined that the swinging motion in the right direction is ended. Namely, the CPU 36 determines that the musical instrument is hit by the swinging motion in the right direction. Accordingly, in a step S29, the processing of outputting the sound of the musical instrument (such as a snare drum on the game screen 100 of FIG. 5) arranged (displayed) on the right side viewed from the player is executed.

Specifically, the CPU 36 determines the musical instrument displayed in the right part of the game screen 100 viewed from the player, and selects the tone data corresponding to the musical instrument. Next, under the instruction of the CPU 36, the DSP 52 applies a predetermined processing to the tone data thus selected, and outputs the tone data thus subjected to predetermined processing. The same thing can be said for the case of outputting the sound. Also, the CPU 36 outputs the sound of the musical instrument and changes the display of the game screen 100 so as to express a condition of hitting the musical instrument. Namely, the CPU 36 displays by animation the image (object) of the musical instrument by following the animation data corresponding to the musical instrument that rings the sound. The same thing can be said for the case of changing the display of the game screen 100, hereafter.

Subsequently, in a step S31, the buffer is cleared. Namely, the acceleration data 92*a* stored in the data memory area 92 is deleted. Then, in a step S33, the rightward flag 92*b* is turned off, and the processing is returned to the music performance processing.

FIG. 15 is a flowchart showing the swinging direction determination and the sound output processing for determining whether or not the controller 22 takes the motion of leftward swinging and outputting the sound corresponding to the determination result. This processing is the same as the processing shown in FIG. 14, and therefore overlapped contents will be simply explained.

As shown in FIG. 15, when the CPU 36 starts to perform the swinging direction determination and the sound output processing, it determines whether or not the leftward flag 92*c* is turned on in a step S41. When the determination in the step S41 shows "YES", namely, when the leftward flag 92*c* is turned on, the processing proceeds to a step S47 as it is. However, when the determination in the step S41 shows "NO", namely, when the leftward flag 92*c* is turned off, it is determined whether or not the acceleration ax of the controller 22 in the x-axial direction is −1.2 or less in a step S43.

When the determination in the step S43 shows "NO", namely, when the acceleration ax is larger than −1.2 g, it is determined that the controller 22 is not swung in the left direction, and the processing is returned to the music performance processing shown in FIG. 13. Meanwhile, when the determination in the step S43 shows "YES", namely, when the acceleration ax is −1.2 g or less, it is determined that the controller 22 is swung in the left direction, and the leftward flag 92*c* is turned on in a step S45, and the processing proceeds to the step S47. Although not shown, at this time, the rightward flag 92*b* and the downward flag 92*d* are turned off.

In the step S47, it is determined whether or not the decrease of the acceleration ax of the controller 22 in the x-axial direction is ended. Here, the CPU 36, for example, detects the acceleration ax up to the current frame from the frame that precedes several frames from it, and determines whether or not the acceleration ax is changed (decreased). When the acceleration ax is decreased, it is determined that the swinging motion in the left direction is not ended. However, when the acceleration ax is not decreased, namely, when the acceleration ax is a fixed value or approximately the fixed value, it is determined that the swinging motion in the left direction is ended.

When the determination in the step S47 shows "NO", namely, when the decrease of the acceleration ax is not ended, the processing is returned to the music performance processing as it is. Meanwhile, when the determination in the step S47 shows "YES", namely, when the decrease of the acceleration ax is ended, it is determined that the swinging motion in the left direction is ended. Namely, it is determined that the musical instrument is hit, by the swinging motion in the left direction. Accordingly, the processing of outputting the sound of the musical instrument (high-hat cymbal on the game screen 100 of FIG. 5) arranged (displayed) on the left side viewed from the player is executed in a step S49. Here, the sound of the high-hat cymbal is outputted and the game screen 100 showing a condition of the high-hat cymbal thus hit is displayed.

Subsequently, in a step S51, the buffer is cleared. Then, in a step S53, the leftward flag 92*c* is turned off, and the processing is returned to the music performance processing.

FIG. 16 is a flowchart showing the swinging direction determination and the sound output processing for determining whether or not the controller 22 takes the motion of vertical (downward) swing, and outputting the sound corresponding to the determination result. As shown in FIG. 16, when the CPU 36 starts to perform the swinging direction determination and the sound output processing, it is determined whether or not the acceleration ay of the controller 22 in the y-axial direction is −0.3 g or more in a step S61. When the determination in the step S61 shows "NO", namely, when the acceleration ay is less than −0.3 g, the processing proceeds to a step S65 as it is. Meanwhile, when the determination in the step S61 shows "YES", namely, when the acceleration ay is −0.3 g or more, the downward flag 92*d* is turned on in a step S63, and the processing proceeds to the step S65. Although not shown, at this time, the rightward flag 92*b* and the leftward flag 92*c* are turned off.

In the step S65, it is determined whether or not the acceleration ay of the controller 22 in the y-axial direction is 0.8 g or more. When the determination in the step S65 shows "YES", namely, when the acceleration ay is −0.3 g or more, and thereafter when the acceleration ay is 0.8 g or more without detecting the negative peak value, the controller 22 is determined to have an upward swinging motion, then the downward flag 92*d* is turned off in a step S79, and the processing is returned to the music performance processing as shown in FIG. 13.

However, when the determination in the step S65 shows "NO", namely, when the acceleration ay is less than 0.8 g, the negative peak value is detected according to the Equation 1 in a step S67. In a subsequent step S69, it is determined whether or not the negative peak value is detected. Namely, it is determined whether or not the acceleration ay of the past three frames including the acceleration ay of the current frame satisfies the Equation 1. When the determination in the step S69 shows "NO", namely, when the negative peak value is not detected, the processing is returned to the step S65 as it is. Meanwhile, when the determination in the step S69 shows "YES", namely, when the negative peak value is detected, the processing proceeds to a step S71 to ring the sound corresponding to a downward swinging motion.

In this way, by the processing from the step S61 to S69, the negative peak value shown by circle Q following a local peak value shown by circle P is detected, as shown in FIG. 10. Whereby, the downward swinging motion is accurately determined.

In the step S71, it is determined whether or not the acceleration az of the controller 22 in the z-axial direction is larger than −0.5 g. Namely, it is determined the posture (stop position) of the controller 22 after the downward swinging motion is ended. When the determination in the step S71 shows "NO", namely, when the acceleration az is −0.5 g or less, it is determined that the controller 22 stops at a relatively higher position, and the processing of outputting the sound of the musical instrument (crush cymbal on the game screen 100 shown in FIG. 5) arranged (displayed) in the upper side viewed from the player is executed in a step S73, and the processing is advanced to a step S77. However, in the step S73, the sound of the crush cymbal is outputted and the game screen 100 showing the condition of hitting the crush cymbal is displayed.

Meanwhile, when the determination in the step S71 shows "YES", namely, when the acceleration az is larger than −0.5 g, it is determined that the controller 22 stops in the vicinity of the horizontal position or at the lower position thereof, and the processing of outputting the sound of the musical instrument (bass drum on the game screen 100 shown in FIG. 5) arranged (displayed) on the lower side viewed from the player is executed in a step S75, and the processing proceeds to the step S77. However, in the step S75, the sound of the bass drum is outputted and the game screen 100 showing the condition of hitting the bass drum is displayed.

In the step S77, the buffer is cleared. Namely, the acceleration data 92*a* stored in the data memory area 92 is deleted. Then, in a step S79, the downward flag 92*d* is turned off and the processing is returned to the music performance processing.

According to this exemplary embodiment, the sound corresponding to a swinging attitude of the controller is outputted, and therefore the sound outputted according to the swinging motion by the user can be enjoyed.

Moreover, according to this exemplary embodiment, the direction of the swinging motion is determined based on the detection result of one acceleration sensor, and the posture of the controller at the time of end of swing is determined. Therefore, the swinging motion of the player can be accurately determined at a low cost.

In this exemplary embodiment, explanation has been given to a case of displaying the image of one musical instrument in the upper part, lower part, left part, and right part of the game screen, respectively. However, the exemplary embodiment is not limited thereto, and it may also be possible to display images of further plural musical instruments, so as to determine a detailed swinging motion, as well as the images in the right/left, and up/down on the screen.

For example, as shown in FIG. 17, when the images A, B, C, D of four musical instruments are arranged side by side in the lateral direction, it is possible to determine which of the musical instruments arranged (displayed) in each direction is hit at the acceleration ax of the controller 22 in the x-axial direction. However, in FIG. 17, a musical instrument A and a musical instrument B are arranged at the position from the center to the left side of the game screen, and a musical instrument C and a musical instrument D are arranged at the position from the center to the right side of the game screen. Specifically, differently from the threshold value (the aforementioned first threshold value and second threshold value) for determining the swinging motion in the left direction or in the right direction, the threshold value for determining the hit musical instrument is provided. Namely, as shown in the lower part of FIG. 17, when the controller 22 is swung in the left direction and the musical instrument A is hit, an inclination angle to the left direction from the reference posture becomes larger than a case of hitting the musical instrument B. Therefore, it is conceivable to speed up (strengthen) the swinging motion. Similarly, when the controller 22 swings in the right direction and the musical instrument D is hit, the inclination angle to the right direction from the reference posture becomes larger than the case of hitting the musical instrument C. Therefore, it is conceivable to speed up (strengthen) the swinging motion.

Figure 18:
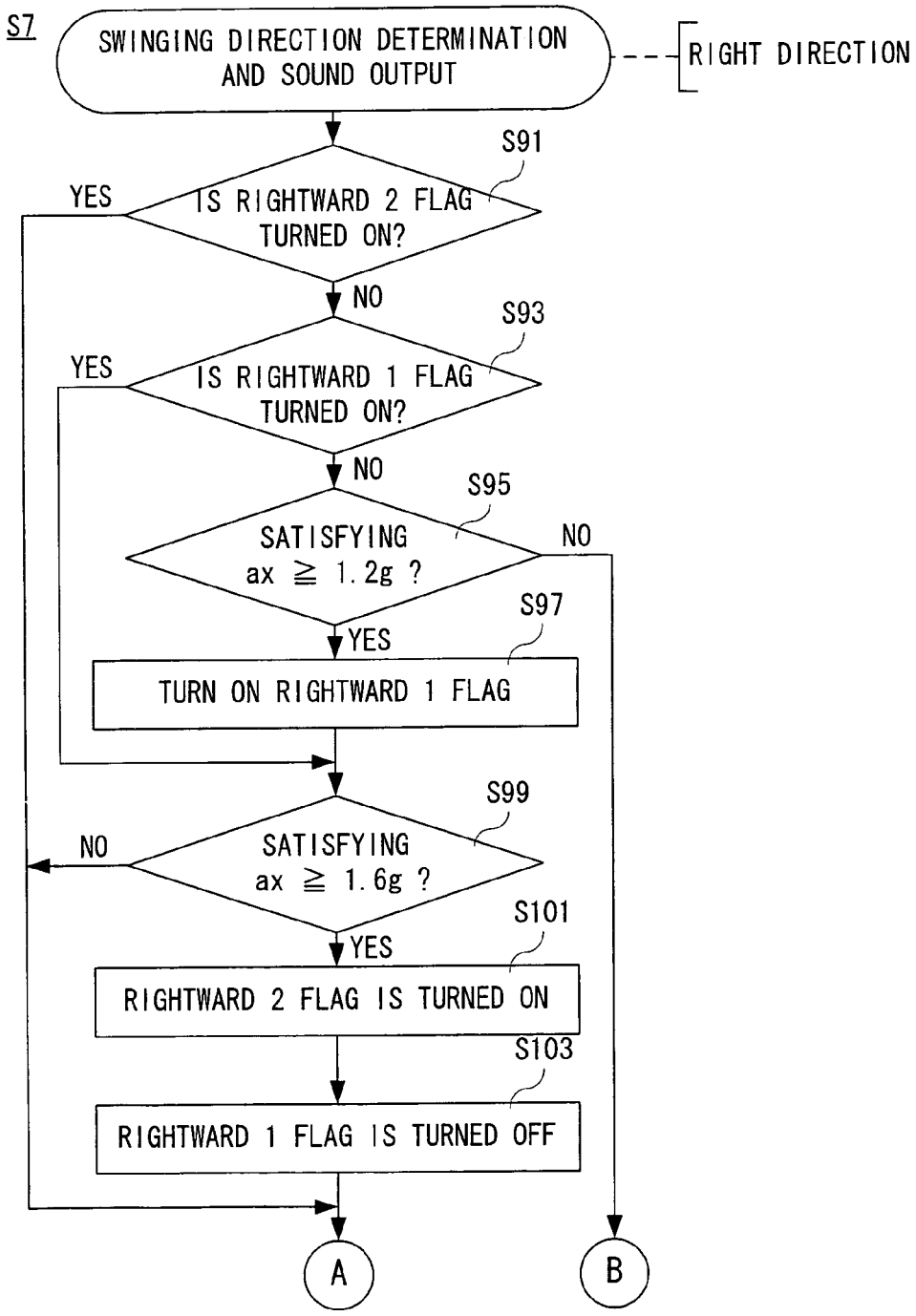
FIG. 18 is a flowchart showing a part of the swinging direction determination and sound output processing for a right direction of the CPU when the game screen shown in FIG. 17 is displayed.
Figure 19:
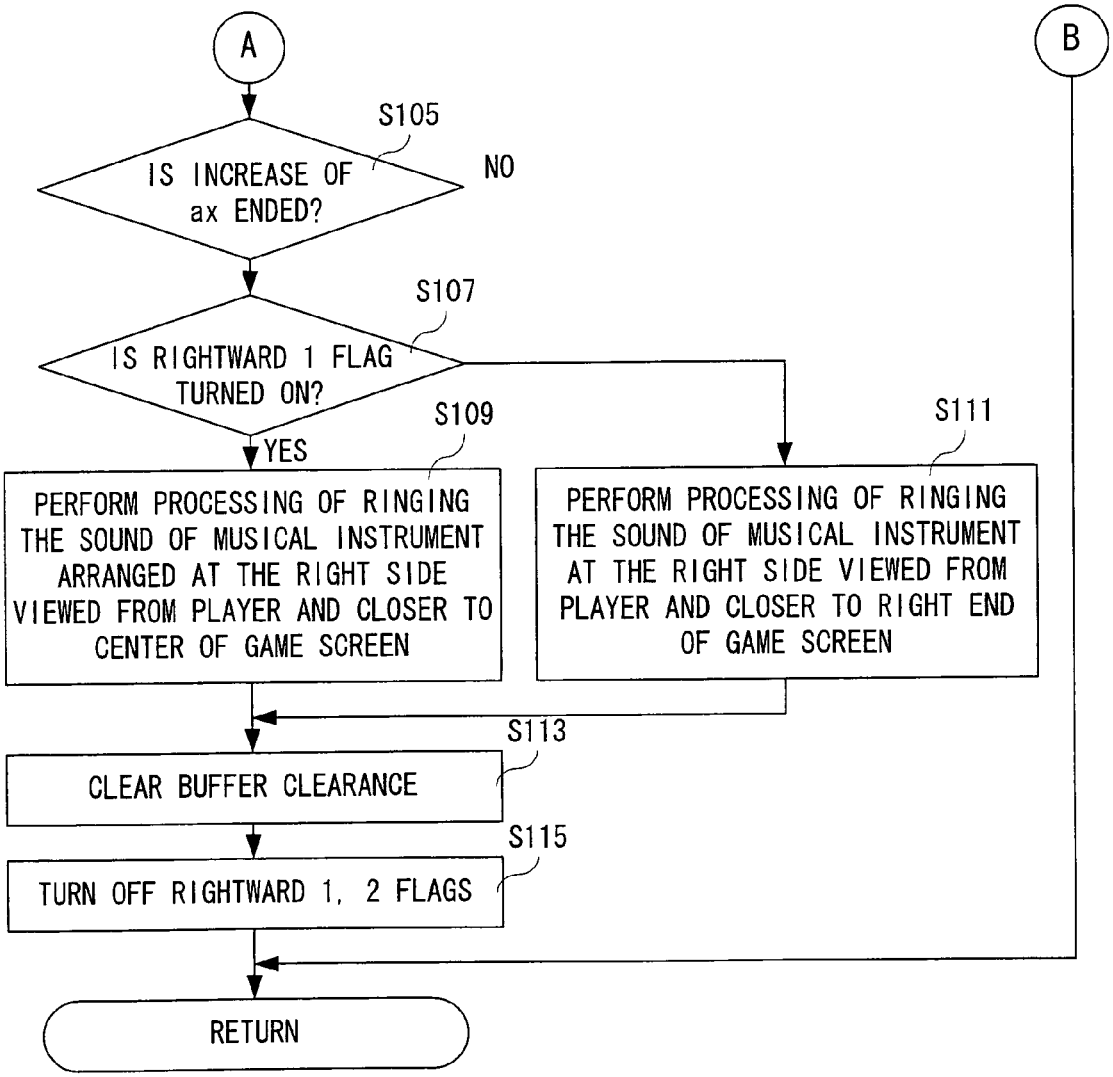
FIG. 19 is a flowchart showing a part of other swinging direction determination and sound output processing for the right direction of the CPU, when the game screen shown in FIG. 17 is displayed, and is the flowchart that follows FIG. 18.

In this case, the flowchart shown in FIG. 14 is changed as shown in FIG. 18 and FIG. 19. Hereafter, the processing shown in FIG. 18 and FIG. 19 are explained. However, the same processing as the processing explained in the above-described exemplary embodiment will be simply explained.

As shown in FIG. 18, when the swinging direction determination and the sound output processing is started, the CPU 36 determines whether or not the rightward 2 flag is turned on in a step S91. Here, the rightward 2 flag is the flag showing that the acceleration ax in the x-axial direction is a fourth threshold value (here 1.6 g) or more, as well as being a first threshold value (here, 1.2 g). Specifically, as shown in FIG. 17 (IV), a state in which the controller 22 is swung so as to largely incline to the right direction from the reference posture is shown. When the determination in the step S91 shows "YES", namely, when the rightward 2 flag is turned on, the processing proceeds to a step S105 as it is as shown in FIG. 19. However, when the determination in the step S91 shows "NO", namely, when the rightward 2 flag is turned off, whether or not the rightward 1 flag is turned on is determined in a step S93. This rightward 1 flag is the flag showing that the acceleration ax in the x-axial direction is the first threshold value or more and less than the fourth threshold value. Specifically, as shown in FIG. 17(III), the state in which the controller 22 is swung so as to be slightly inclined to the right direction from the reference posture is shown.

When the determination in the step S93 shows "YES", namely, when the rightward 1 flag is turned on, the processing proceeds to a step S99 as it is. Meanwhile, when the determination in the step S93 shows "NO", namely, when the rightward 1 flag is turned off, it is determined whether or not the acceleration ax is 1.2 g or more in a step S95. Namely, it is determined whether or not this is the swinging motion in the right direction. When the determination in the step S95 shows "NO", as shown in FIG. 19, the processing is returned to the music performance processing as it is as shown in FIG. 13. However, when the determination in the step S95 shows "YES", the rightward 1 flag is turned on in a step S97 and the processing is advanced to the step S99.

In step S99, it is determined whether or not the acceleration ax is the fourth threshold value (here 1.6 g) or more. When the determination in the step S99 shows "NO", namely, when the acceleration ax is less than 1.6 g, the processing proceeds to the step S105 as it is. Meanwhile, when the determination in the step S99 shows "YES", namely, when the acceleration ax is 1.6 g or more, the rightward 2 flag is turned on in a step S101, and the rightward 1 flag is turned off in a step 103, and the processing proceeds to the step S105.

Note that in order to accurately determine which of the musical instrument C or the musical instrument D is hit, the rightward 1 flag is turned off in the step S103.

As shown in FIG. 19, it is determined whether or not the increase of the acceleration ax is ended in the step S105. Namely, it is determined whether or not the swinging motion of the controller 22 in the right direction is ended. When the determination in the step S105 shows "NO", the processing is returned to the music performance processing as it is. Meanwhile, when the determination in the step S105 shows "YES", namely, when the increase of the acceleration ax is ended, it is determined whether or not the rightward 1 flag is turned on in a step S107.

When the determination in the step S107 shows "YES", namely, when the rightward 1 flag is turned on, the processing of outputting the sound of the musical instrument arranged (displayed) at the right side viewed from the player and at the position closer to the center of the game screen is executed in a step S109, and the processing proceeds to a step S113. Meanwhile, when the determination in step the S107 shows "NO", namely, when the rightward 2 flag is turned on, the processing of outputting the sound of the musical instrument arranged (displayed) at the right side viewed from the player and at the position closer to a right end of the game screen is executed in a step S111, and the processing proceeds to the step S113. Then, in the step S113, the buffer is cleared, and in a step S115, the rightward 1 flag or the rightward 2 flag is turned off, and the processing is returned to the music performance processing.

Note that although not shown, similarly in the left direction, by setting two threshold values, it is accurately determined which of the two musical instruments (A and B in the example shown in FIG. 17) is hit, and the processing of outputting the sound of the musical instrument thus hit can be executed.

In addition, by arranging three or more musical instruments in the vertical direction also, it is accurately determined which of the musical instruments is hit, thus making it possible to ring the sound of the hit musical instrument. As being explained in the aforementioned exemplary embodiment, in the vertical direction, by the value of the acceleration az in the z-axial direction at the time of end of the swinging motion, the posture of the controller 22, i.e. the stop state thereof is determined, thereby also determining which of the musical instruments is hit. Therefore, the threshold value for determining the stop state of the controller 22 may be set in accordance with the number of the musical instruments to be displayed.

Figure 20:
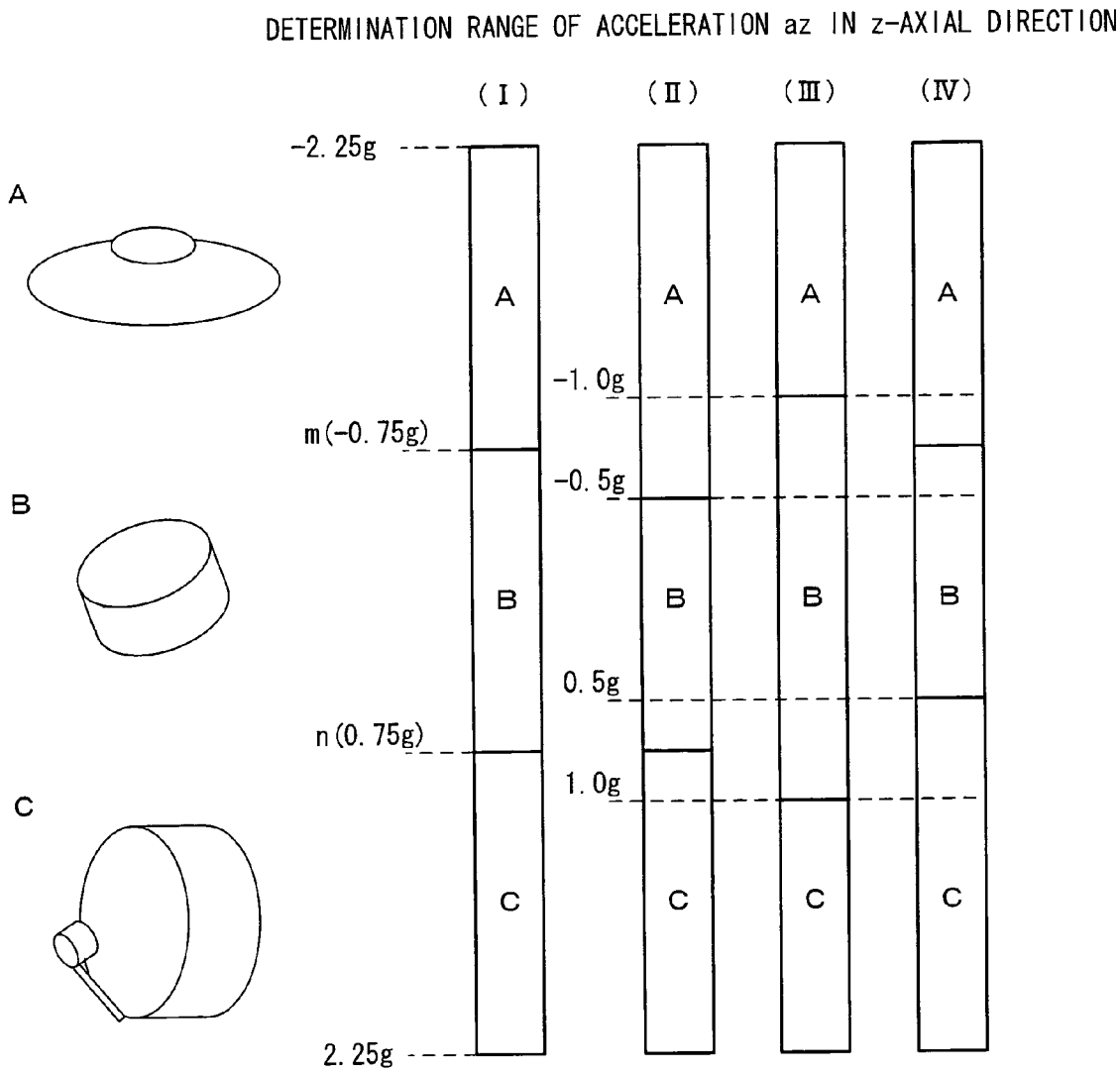
FIG. 20 is an illustrative view for explaining the example of the arrangement of the music instruments displayed on the other game screen of certain exemplary embodiments and a setting method of a threshold value in a different scene of a game.

For example, as shown in FIG. 20, when three musical instruments A, B, C are vertically arranged (displayed), two threshold values are set. Specifically, as shown in FIG. 20 (I), a threshold value m (−0.75 g) and a threshold value n (0.75 g)

are set. However, in FIG. 20, a detection range of the acceleration az is set from −2.25 g to 2.25 g. This is because, as shown in FIG. 20 (I), the range of the acceleration az for determining the musical instruments A, B, C must be made equal. Accordingly, as shown in FIG. 16, when the determination in the step S69 shows "YES" to ring the sound of the musical instrument, the acceleration az is detected and by using two threshold values m and n, which of the musical instruments A, B, C is hit is determined. Specifically, when the acceleration az is equal to the threshold value m or smaller, it is so determined that the musical instrument A is hit. Also, when the acceleration az is equal to the threshold value m or greater and equal to the threshold value n or smaller, it is so determined that the musical instrument B is hit. Further, when the acceleration az is greater than the threshold value n, it is so judged that the musical instrument C is hit.

In this way, in regard to the swinging motion in the lateral direction, it is possible to determine the swinging direction and the hit musical instrument, based on the acceleration in the direction of one axis (e.g. x-axis). Also, in regard to the swinging motion in the vertical direction, it is possible to determine the downward swinging motion based on the acceleration in the direction of one of the two axes (for example, y-axis) for the swinging motion in the vertical direction, and after the swinging motion is ended, based on the acceleration in the direction of the other one axis (for example z-axis), it is possible to determine the hit musical instrument.

Further, although a detailed explanation is omitted, for example, in a game such as outputting the sound by hitting the musical instrument instructed by a video game apparatus, it is possible to change the threshold value each time the musical instrument is hit, to accurately determine whether or not the musical instrument to be hit this time is really hit. For example, in a scene where the musical instrument A is hit, as shown in FIG. 20 (II), for example, the threshold value m is set (changed) to −0.5 g. Namely, the range of the acceleration az whereby the musical instrument A is determined to be hit, is made large. Also, in the scene where the musical instrument B is hit, as shown in FIG. 20 (III), the threshold value m is set to −1.0 g, and the threshold value n is set to 1.0 g. Namely, the range of the acceleration az whereby the musical instrument B is determined to be hit, is made large. In addition, in a scene where the musical instrument C is hit, as shown in FIG. 20 (IV), the threshold value n is set (changed) to 0.5 g. Namely, the range of the acceleration az whereby the musical instrument C is determined to be hit, is made large.

In this way, when the threshold value is variably set, the musical instrument hit by the player can be accurately determined, even when a relatively many musical instruments are displayed.

Although certain exemplary embodiments have been described and illustrated in detail, it is clearly understood that the same is by way of illustration and example only and is not to be taken by way of limitation, the spirit and scope of these certain exemplary embodiments being limited only by the terms of the appended claims.

What is claimed is:

1. A non-transitory storage medium storing a sound output program of a sound output apparatus having an operating unit including an acceleration sensor, wherein the sound output program causes a processor of the sound output apparatus to perform operations comprising:

detecting a swinging motion of the operating unit based on an output of the acceleration sensor;

determining when the output of the acceleration sensor becomes constant or approximately constant, after the swinging motion is detected;

determining aspects of a posture of the operating unit based on the output of the acceleration sensor, after it is determined that the output of the acceleration sensor has become constant or approximately constant; and outputting sound based on stored tone data, in accordance with a determination result of determining aspects of a posture of the operating unit.

2. The non-transitory storage medium according to claim 1, wherein the acceleration sensor comprises a multiaxial acceleration sensor;

the sound output program causes the processor to perform further operations comprising determining a direction of the swinging motion based on acceleration in directions of two axes of the multiaxial acceleration sensor;

the determining of aspects of a posture of the operating unit includes determining an inclination of the operating unit to a horizontal surface in a vertical direction based on acceleration in the direction of an axis perpendicularly crossing the two axes, when it is determined that the direction of the swinging motion is a vertical direction; and the outputting of sound based on stored tone data includes reading the tone data in accordance with a position in the vertical direction following the determined inclination.

3. The non-transitory storage medium according to claim 1, wherein, when it is determined that the direction of the swinging motion is a rightward direction, the stored tone data is read in accordance with the rightward direction, and, when it is determined that the direction of the swinging motion is a leftward direction, the stored tone data is read in accordance with the leftward direction.

4. The non-transitory storage medium according to claim 2, wherein the sound output apparatus further comprises a display;

the sound output program causes the processor to display on the display a guidance screen for guiding the swinging motion; and a determined direction of the swinging motion corresponds to a direction in the guidance screen.

5. A sound output apparatus having an operating unit including an acceleration sensor, comprising:

a processor;

a memory coupled to the processor, the memory storing instructions that, when executed by the processor, control the processor to perform operations comprising:

detecting a swinging motion of the operating unit based on an output of the acceleration sensor;

determining when the output of the acceleration sensor becomes constant or approximately constant, after the swinging motion is detected;

determining aspects of a posture of the operating unit based on the output of the acceleration sensor, after it has been determined that the output of the acceleration sensor has become constant or approximately constant; and outputting sound based on tone data stored in a storage, in accordance with the determined aspects of a posture of the operating unit.

6. A sound output control method for a sound output apparatus having an operating unit including an acceleration sensor, the method comprising:

(a) detecting a swinging motion of the operating unit based on an output of the acceleration sensor;

(b) determining when the output of the acceleration sensor becomes constant or approximately constant, after the swinging motion is detected in (a);

(c) determining aspects of a posture of the operating unit based on the output of the acceleration sensor, after determination in (b) shows that the output of the acceleration sensor has become constant or approximately constant; and (d) outputting sound based on tone data stored in a storage in accordance with a determination detection result in (c).

7. A sound output system, comprising:

an operating unit including an acceleration sensor;

a moving motion detector that detects a swinging motion of the operating unit based on an output of the acceleration sensor;

a determiner that determines when the output of the moving motion detector becomes constant or approximately constant, after the swinging motion is detected by the moving motion detector;

a posture determiner that determines aspects of a posture of the operating unit based on the output of the acceleration sensor, after it is determined that the output of the acceleration sensor has become constant or approximately constant; and an outputter that outputs sound based on stored tone data in accordance with a result of the posture determiner.

8. A sound output system, comprising:

a user control device including an inertial sensor and communication circuitry for wirelessly transmitting inertial sensor data; and an electronic machine comprising:

communication circuitry for receiving the inertial sensor data wirelessly transmitted by the user control device; and processing circuitry for detecting a swinging motion of the user control device based on the inertial sensor data for multiple times; determining, subsequent to the detecting of the swinging motion, when the inertial sensor data for multiple times indicates that acceleration of the user control device has become constant or approximately constant; determining, when the inertial sensor data is determined to indicate that the acceleration of the user control device has become constant or approximately constant, aspects of a posture of the user control device based on the inertial sensor data; and outputting tone data based on the determined aspects of posture.

* * * * *